US011261391B1

(12) United States Patent
Dec et al.

(10) Patent No.: US 11,261,391 B1
(45) Date of Patent: Mar. 1, 2022

(54) FUEL AND FUEL BLEND FOR INTERNAL COMBUSTION ENGINE

(71) Applicant: National Technology & Engineering Solutions of Sandia, LLC, Albuquerque, NM (US)

(72) Inventors: John E. Dec, Livermore, CA (US); Yi Yang, Box Hill North (AU)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 1920 days.

(21) Appl. No.: 14/686,953

(22) Filed: Apr. 15, 2015

Related U.S. Application Data

(60) Provisional application No. 61/981,389, filed on Apr. 18, 2014.

(51) Int. Cl.

| | |
|---|---|
| ***C10L 1/185*** | (2006.01) |
| ***C10L 10/10*** | (2006.01) |
| ***C10L 10/06*** | (2006.01) |
| ***C10L 10/02*** | (2006.01) |
| ***F02B 47/04*** | (2006.01) |

(52) U.S. Cl.
CPC ..... *C10L 1/1857* (2013.01); *C10L 10/02* (2013.01); *C10L 10/06* (2013.01); *C10L 10/10* (2013.01); *F02B 47/04* (2013.01); *C10L 2270/02* (2013.01)

(58) Field of Classification Search
CPC ..... C10L 10/10; C10L 1/14; C10L 1/1857; C10L 1/224; C10L 10/06; C10L 10/02; C10L 2270/02; F02B 47/04
See application file for complete search history.

(56) References Cited

U.S. PATENT DOCUMENTS 2,176,747 A * 10/1939 Schneider ..... C10L 1/023 44/439
3,098,100 A * 7/1963 Freure ..... B01J 27/1808 568/404
4,844,717 A * 7/1989 Croudace ..... C10L 1/14 123/1 A
5,316,558 A * 5/1994 Gonzalez ..... C10L 1/14 44/340

(Continued)

OTHER PUBLICATIONS

Mends et al. "An Endophytic *Nodulisporium* sp. Producing Volatile Organic Compounds Having Bioactivity and Fuel Potential". Journal of Petroleum & Environmental Biotechnology. Mar. 2012. Volum3 3. Issue 3. pp. 1-7.*

(Continued)

*Primary Examiner* — Latosha Hines
(74) *Attorney, Agent, or Firm* — Medley, Behrens & Lewis, LLC; Madelynne J. Farber

(57) ABSTRACT

A fuel or fuel blending agent for an internal combustion engine includes a ketone compound that is a $C_4$ to $C_{10}$ branched acyclic ketone, cyclopentanone, or a derivative of cyclopentanone. The ketone compound may be blended with a majority portion of a fuel selected from the group consisting of: gasoline, diesel, alcohol fuel, biofuel, renewable fuel, Fischer-Tropsch fuel, or combinations thereof. The ketone compound may be derived from biological sources. A method for powering an internal combustion engine with a fuel comprising the ketone compound is also provided.

11 Claims, 11 Drawing Sheets

(56) References Cited

U.S. PATENT DOCUMENTS

| | | | | |
|---|---|---|---|---|
| 2002/0000063 | A1* | 1/2002 | Yeh | C10L 1/026 44/437 |
| 2002/0026744 | A1* | 3/2002 | Golubkov | C10L 1/026 44/436 |
| 2002/0104256 | A1* | 8/2002 | Yeh | C10L 1/026 44/451 |
| 2002/0108299 | A1* | 8/2002 | Yeh | C10L 1/026 44/439 |
| 2003/0154649 | A1* | 8/2003 | Hull | C10L 1/023 44/350 |
| 2009/0038597 | A1* | 2/2009 | Phillips | F01L 1/465 123/70 R |
| 2014/0076291 | A1* | 3/2014 | Wong | F02D 19/105 123/568.11 |

OTHER PUBLICATIONS

Lam, et al., "Shock Tube Measurements of 3-Pentanone Pyrolysis and Oxidation", In Combustion and Flame, The Combustion Institute, vol. 159, 2012, pp. 3251-3263.

Boot, et al., "Cyclic Oxygenates: A New Class of Second-Generation Biofuels for Diesel Engines?", In Energy and Fuels, American Chemical Society, 2009, vol. 23, pp. 1808-1817.

Serinyel, et al., "Experimental and Chemical Kinetic Modeling Study of 3-Pentanone Oxidation", In Journal of Physical Chemistry, American Chemical Society, 2010, vol. 114, pp. 12176-12186.

Dec, et al., "Efforts of Gasoline Reactivity and Ethanol Content on Boosted, Premixed and Partially Stratified Low-Temperature Gasoline Combustion (LTGC)", In SAE Int. J. Engines, vol. 8, No. 3, Apr. 14, 2015, 21 pages.

Griffin, et al., "Volatile Organic Compound Production by Organisms in the Genus Ascocoryne and a Re-evaluation of Myco-Diesel Production", In Microbiology, vol. 156, 2010, pp. 3814-3829.

Sjoberg, et al., "Ethanol Autoignition Characteristics and HCCI Performance for Wide Ranges of Engine Speed, Load and Boost", In SAE Int. J. Engines, vol. 3, No. 1, Apr. 12, 2010, pp. 84-106.

Yang, et al.. "Characteristics of Isopentanol as a Fuel for HCCI Engines", In SAE Int. J. Fuels Lubr., vol. 3, No. 2, Oct. 25, 2010, pp. 725-741.

* cited by examiner

FUEL AND FUEL BLEND FOR INTERNAL COMBUSTION ENGINE

CROSS-REFERENCE TO RELATED APPLICATION

This application claims priority to U.S. Provisional 61/981,389, filed on Apr. 18, 2014, which is hereby incorporated by reference in its entirety.

STATEMENT OF GOVERNMENTAL INTEREST

This invention was developed under Contract DE AC04-94AL85000 between Sandia Corporation and the U.S. Department of Energy. The U.S. Government has certain rights in this invention.

FIELD

This disclosure relates to fuel and fuel blending agents. More specifically, this disclosure relates to fuel and fuel blending agents for internal combustion engines.

BACKGROUND

Biofuels are increasingly used to supplement conventional petroleum-derived fuels for transportation. As a renewable energy source, biofuels help to reduce dependence on fossil-fuel, mitigate greenhouse-gases emissions, and in some cases, improve air quality. Mandates for biofuels have been established around the world, requiring an even larger increase in biofuel usage in the future. Second-generation biofuels, using non-food-crop feedstocks, will contribute the major part of these increases. For example, US EPA has mandated that by 2022, 21 out of 36 billion gallons of biofuels (about 20% of total projected fuel demands) must be advanced biofuels produced from cellulosic or other non-food feedstocks.

With respect to the development of practical strategies for producing second-generation biofuels, the current practice involves feedstock pre-treatment (breaking down biomass), separation of cellulose, conversion of cellulose to simple sugars, and fermentation of sugars to alcohols. A major area of difficulty in this process is the recalcitrance of lignocellulosic biomass, which requires extensive pre-treatment of the feedstock and consequently reduces energy efficiency and increases the cost of production. One potential means of addressing this difficulty is the exploitation of natural biological mechanisms for breaking down biomass. For example, certain fungi, endophytes, naturally consume cellulose and excrete volatile organic compounds (VOC)—hydrocarbons and hydrocarbon derivatives—that may have utility as fuels. See, e.g., Griffin, M. A., Spakowicz, D. J., Gianoulis, T. A., Strobel, S. A., Volatile Organic Compound Production by Organisms in the Genus Ascocoryne and a Re-evaluation of Myco-diesel Production by NRRL, 50072 Microbiology 2010, 156: p. 3814-3829.

Ketones are prominent in the VOC streams from several different fungi see id. and Mends, M. T., Yu, E., Strobel, G. A., Riyaz-Ul-Hassan, S., Booth, E., Geary, B., Sears, J., Taatjes, C. A., Hadi, M. Z., An Endophytic Nodulisporium sp. Producing Volatile Organic Compounds Having Bioactivity and Fuel Potential, J. Petrol. Environ. Biotechnol., 2012, 3: p. 117., but their combustion chemistry and application in engines are not well understood. Furthermore, the suitability of a fuel for combustion applications depends on many properties.

In addition, to meet mandates for improved fuel economy, manufacturers are developing boosted, down-sized engines that are much more fuel efficient than current spark-ignition engines. Turbo-boosting and super-charging internal combustion engines can improve energy efficiency, but these engines require higher octane fuels, and autoignition of high octane fuel becomes a problem. Effectively increasing the compression ratio of boosted engines is also a challenge.

SUMMARY

With their superior anti-knock properties, the compounds described herein may be used neat or as blending components with gasoline or other compounds to produce better fuels that could facilitate development of highly efficient engines, such as boosted, down-sized spark-ignition (SI) internal combustion engines, SI engines with a higher compression ratio (naturally aspirated or boosted), or other highly efficient engines that will be developed in the future. The compounds described herein may also be used as neat fuels or mixed fuels (with gasoline or other fuel compounds) in certain advanced engines, such as Homogeneous Charge Compression Ignition (HCCI) engines, or more generally in Low-Temperature Gasoline Combustion (LTGC) engines (using gasoline-like fuels), that have the high-efficiency advantages of HCCI but can operate with some level of charge inhomogeneities.

In an embodiment, an enhanced fuel for an internal combustion engine includes a majority portion of a fuel selected from the group consisting of: gasoline, diesel, alcohol fuel, biofuel, renewable fuel, Fischer-Tropsch fuel, or combinations thereof; and a minority portion of a ketone-based blending agent. The ketone-based blending agent is a $C_4$ to $C_{10}$ branched acyclic ketone, cyclopentanone, or a derivative of cyclopentanone.

In an embodiment, a method for powering an internal combustion engine includes the steps of combusting a fuel to drive a piston in a cylinder of the engine. The fuel comprises a ketone-based fuel selected from a $C_4$ to $C_{10}$ branched acyclic ketone, cyclopentanone, or a derivative of cyclopentanone.

In an embodiment, a method for powering an internal combustion engine includes, combusting a fuel to drive a piston in a cylinder of the engine. The fuel comprises a ketone-based fuel selected from a $C_4$ to $C_{10}$ branched acyclic ketone, cyclopentanone, or a derivative of cyclopentanone; and an additional fuel selected from the group consisting of: gasoline, diesel, biofuel, renewable fuel, Fischer-Tropsch fuel, alcohol fuel or combinations thereof.

The term "blending agent" is used herein to mean both agents used in large amounts and also to encompass agents added in small amounts that might be considered an "additive" in the art.

DETAILED DESCRIPTION

Figure 1:
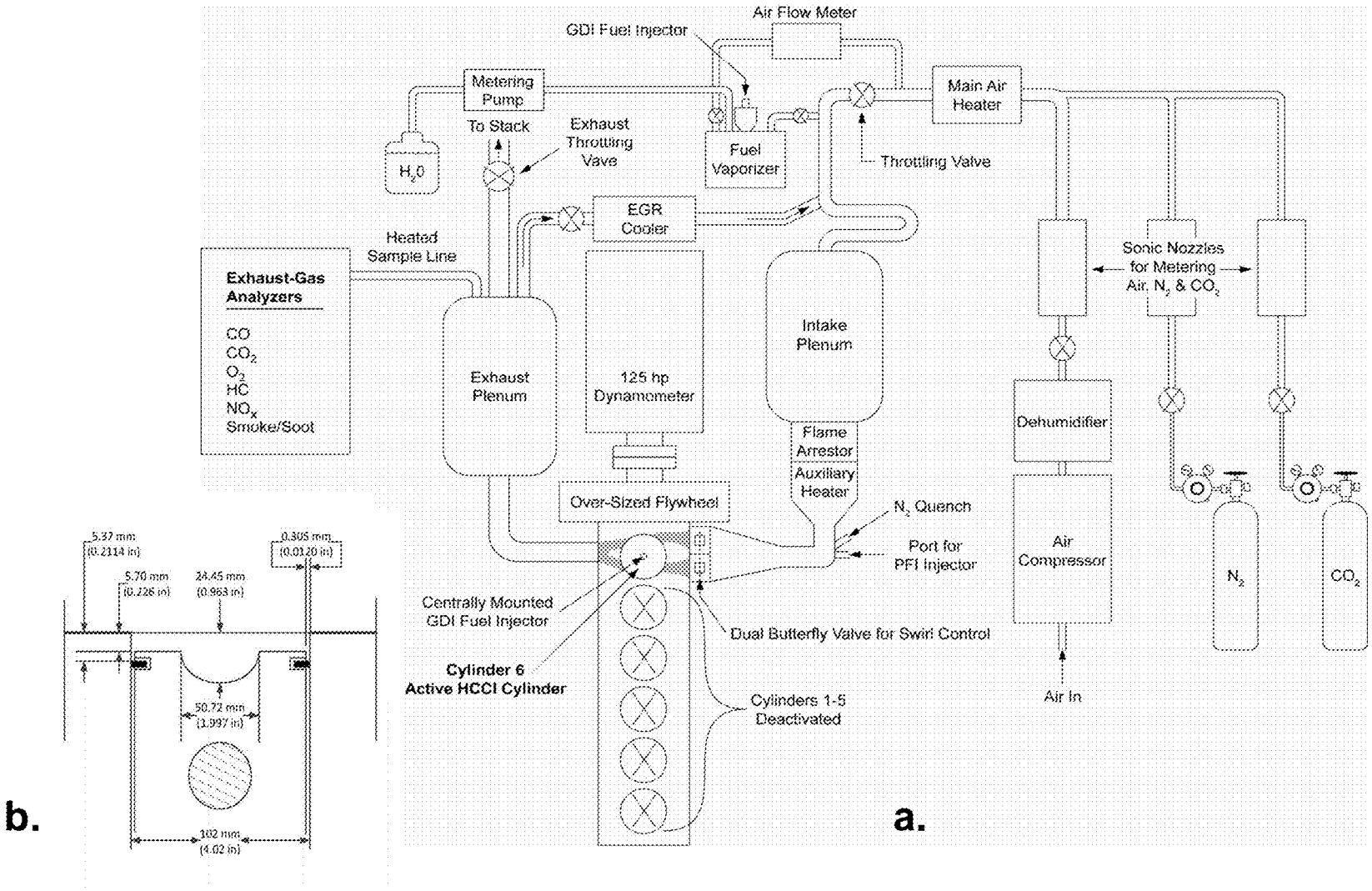
FIG. 1 is a schematic of: (a) an HCCI/LTGC engine facility used in the examples of this application, and (b) combustion chamber geometry of a CR=14 piston at TDC.

This present disclosure involves the use of a $C_4$ to $C_{10}$ branched ketone or cyclopentanone or a derivative thereof as a blending component for fuels, including, but not limited to gasoline. In an embodiment, the $C_4$ to $C_{10}$ branched ketone or cyclopentanone or a derivative thereof would be used as neat fuel or as a substantial blend with a traditional fuel (e.g. gasoline) or other fuel compounds) in spark-ignition (SI) engines that could be either naturally aspirated or using intake-pressure boost, and could use conventional compression ratios or increase compression ratios as permitted by the use of these fuels. In another embodiment, the ketone fuels (neat or in blends) may also be used for certain other types of engines, such as Homogeneous Charge Compression Ignition (HCCI) engines, or more generally, in Low-Temperature Gasoline Combustion (LTGC) engines (using gasoline-like fuels), that have the high-efficiency advantages of HCCI but can operate with some level of charge inhomogeneities. The term LTGC includes HCCI and stratified, partially stratified, and spark-assisted variants that still provide the high efficiency and low emission of HCCI, but work better over a wider operating range. See, for example, Dec, J. E., Yang, Y., Ji, C., and Dernotte, J., "Effects of Gasoline Reactivity and Ethanol Content on Boosted, Premixed and Partially Stratified Low-Temperature Gasoline Combustion (LTGC)," SAE technical paper no. 2015-01-0813, accepted for publication in the SAE J. of Engines, 2015.

As disclosed herein, research on these ketone compounds in an HCCI engine showed that they are highly resistant to autoignition. Cyclopentanone in particular, was found to be significantly harder to autoignite than gasoline or ethanol at naturally aspirated conditions, i.e. it is more resistant to engine knock. Furthermore, its autoignition showed even less enhancement with intake-pressure boosting (simulated turbocharging) than ethanol, which is the main blending compound currently being considered to improve the knock resistance of gasoline in boosted engines. The results obtained under HCCI engine conditions are also indicative of autoignition properties in traditional spark-ignition engines.

In an embodiment, two ketones, 2,4-dimethyl-3-pentanone (DMPN), also called di-isopropyl ketone) and cyclopentanone (CPN), were chosen to represent short chain ($C_4$ to $C_{10}$) branched ketones and cyclic ketones. These compounds have been observed in VOC streams produced by fungi, and can also be produced by other means, such as, for example, a fermentation process using genetically engineered microbes, which has already been shown to at least produce longer straight chain ketones. The ketone compounds can be derived by chemical processes from either biological or fossil feedstocks.

General molecular structures of the two classes of ketone compounds are shown below in formulas I and II. Formula I represents cyclopentanone or a derivative of cyclopentanone.

I

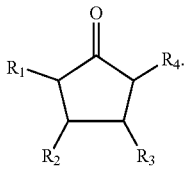

wherein $R_1$, $R_2$, $R_3$, and $R_4$, are independently selected from H, $CH_3$, or $CH_2CH_3$.

Formula II represents a $C_4$ to $C_{10}$ acyclic branched ketone.

II

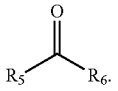

wherein each of $R_5$ and $R_6$ are independently selected from $CH_3$ and any $C_2$ to $C_8$ alkyl hydrocarbon groups, provided that a total number of carbon atoms in the acyclic branched ketone is 4 to 10, and that at least one of $R_5$ and $R_6$ are branched $C_3$ to $C_8$ alkyl hydrocarbon groups.

For example, the branched $C_3$ to $C_8$ alkyl hydrocarbon groups may be selected from: $CH(CH_3)_2$, $CH_2CH(CH_3)_2$, $CH_2C(CH_3)_3$, $CH(CH_3)CH(CH_3)_2$, $C(CH_3)_3$, $C(CH_3)_2CH_2CH_3$, $C(CH_3)_2CH_3$, $C(CH_3)_2CH(CH_3)_2$, $CH(CHCH_3)_2$, $C(CHCH_3)_2(CH_3)$, $CH_2CH(CH_2CH_3)(CH_3)$.

The $C_9$ or $C_{10}$ embodiment may be branched at any carbon atom along the chain in the $R_5$ or $R_6$ groups. The $C_9$ or $C_{10}$ embodiments may be especially useful in blends with diesel fuel.

The examples disclosed herein indicate the two ketone compounds disclosed herein have a lower autoignition reactivity than gasoline or ethanol when used in an internal combustion engine operating at normal, naturally aspirated (1 bar) intake pressure ($P_{in}$) conditions. At this $P_{in}$ and a speed of 1200 rpm, the intake temperature ($T_{in}$) required to achieve autoignition in an HCCI engine with a compression ratio of 14:1 for these compounds may range from 156-175° C., such as for example, 160 to 170° C. Also, at this same $P_{in}$ and speed, autoignition of both ketone compounds showed a higher sensitivity to temperature variations than gasoline or ethanol, as indicated by larger changes in CA50 for a given change in $T_{in}$.

Regarding cyclopentanone and derivatives thereof, the autoignition of cyclopentanone shows even lower sensitivity to changes in intake pressure $P_{in}$ than ethanol, as indicated by its relatively small $T_{in}$ reduction for a given $P_{in}$ increase in the Examples. Also, its intermediate temperature heat release (normalized) showed no enhancement by $P_{in}$ for the 1 to 1.8 bar pressure range examined, and it is even weaker than that of ethanol. This data indicates that these fuels should work well for boosted SI engines, because its knock propensity (propensity for autoignition) increases only very slightly with boost, which is in stark contrast to gasoline. Also, the lack of reactivity enhancement with increased $P_{in}$ shows that the fuel will allow a higher compression ratio without knock (which enables higher efficiencies). Finally, higher compression ratios can be used in combination with boost, with significant benefits for efficiency. The extremely low autoignition reactivity enhancement with increased $P_{in}$ also makes CPN an ideal fuel or blending agent for turbocharged spark-ignition engines to provide improvement in anti-knock properties.

The trends in the autoignition characteristics of cyclopentanone with changes in $P_{in}$, $T_{in}$, and engine speed are quite similar to ethanol, except that it has an even lower autoignition reactivity at all conditions tested.

Regarding the acyclic branched $C_4$ to $C_{10}$ ketone that was tested, 2,4-dimethyl-3-pentanone (DMPN), its autoignition is considerably more sensitive to (more promoted by) increases of $P_{in}$ than ethanol. The rate of $T_{in}$ reduction with increasing $P_{in}$ is similar to gasoline; however, the DMPN remained less reactive than gasoline at all $P_{in}$ tested (see FIG. 6). Additionally, DMPN showed a distinctive low-temperature heat release (LTHR) at $P_{in} \geq 1.8$ bar, which appears earlier in the compression stroke than the LTHR of traditional hydrocarbon fuels, such as gasoline (see FIG. 8). This suggests DMPN has a unique and unexpected autoignition chemistry. The autoignition characteristics of DMPN provided improved performance when run as a neat fuel in an intake-boosted combustion engine, in particular an HCCI engine. This indicates it should also be useful as neat fuel in spark ignition engines. At $P_{in}$=2.4 bar and $T_{in}$=60° C., the HCCI combustion of DMPN reaches a similar maximum load (about 14 bar IMEP) to that of gasoline. In contrast with gasoline, which required significant combustion-timing retard to prevent knock, DMPN achieved this load with more advanced combustion timing because its high temperature-sensitivity produced a lower heat release rate. This, together with DMPN's lower autoignition reactivity, which requires less EGR to control CA50, gave a higher thermal efficiency than gasoline for high-load boosted operation. These results indicate that acyclic branched $C_4$ to $C_{10}$ ketones, such as DMPN can be a good fuel for high-load internal combustion engine operation, in particular, HCCI engines.

In addition, the lower reactivity (indicative of a higher RON) that the ketone-based compounds provide can enable engines to run with higher compression ratios (CR), which can increase efficiency and/or power density. In some embodiments, for example, it may be desirable to increase the CR and run naturally aspirated (zero boost). In some embodiments, both CR and boost may be raised. In others, the CR is not altered, but the boost is raised to higher levels. These options can be adjusted for desired performance and fuel economy, e.g. in economy vehicles, sports cars, and race cars.

As mentioned above, the compounds disclosed herein, in particular cyclopentanone and 2,4-dimethyl-3-pentanone may be recovered from the action of certain fungi on biomasses to produce streams of volatile organic compounds (VOCs). Reference may be made to the following publications for further information on this process. Mends, M. T., Yu, E., Strobel, G. A., Riyaz-Ul-Hassan, S., Booth, E., Geary, B., Sears, J., Taatjes, C. A., Hadi, M. Z., *An Endophytic Nodulisporium sp. Producing Volatile Organic Compounds Having Bioactivity and Fuel Potential*. J. Petrol. Environ. Biotechnol, 2012. 3: p. 117 and Yu, E. T., Tran-Gyamfi, M., Strobel, G., Taatjes, C., Hadi, M. Z., *VOC Profile of Endophytic Fungi is Altered by Nature of Lignocellulosic Biomass Feedstock*, submitted to Biores. Technol., 2013. These types of compounds, may also be produced by a fermentation process using genetically engineered microbes, which has already been shown to at least produce longer straight chain ketones.

The ketone compounds disclosed herein are also available from commercial sources and/or may be produced by known organic chemical techniques.

The examples herein are performed with neat examples of the ketone compounds used as fuels in an HCCI engine; however, the results indicate that the ketone compounds, can also be used neat or as blending agents in traditional fuels in internal combustion engines, such as LTGC engines in general or spark-ignition engines, such as gasoline, alcohols, or gasoline-alcohol blends. Both ketone compounds indicate they would function to reduce knocking in spark ignition engines compared to gasoline. In particular, because of its high autoignition temperature and little variance to boosted intake pressures, the cyclopentanone or derivative of cyclopentanone compounds would have excellent anti-knock qualities neat or as a blend component in a fuel for an SI engine that is naturally aspirated or boosted. Additionally, this anti-knock quality of the ketone compounds would allow for higher compression ratios in both naturally aspirated and boosted SI engines.

In an embodiment, the fuel blend comprises a majority portion of a fuel selected from the group consisting of: gasoline, alcohols (for example, ethanol, methanol, or butanol), diesel fuel, or combinations thereof, and a minority portion of a ketone-based compound. For example, the majority portion may be a blend of gasoline and ethanol, such as, but not limited to, the 10% ethanol in gasoline blends currently sold as pump gasoline in the U.S. In an embodiment, the majority portion fuel comprises 51% to 99.9% of the total fuel by liquid volume, such as, for example, 60% to 98%, or 80% to 95%, and the minority portion of the fuel is the ketone blending agent, for example, 5% to 0.01%, 20% to 5%, or 40% to 10% of the total fuel by liquid volume. In an embodiment, the majority portion fuel is present in a volume ratio with the ketone compound blending agent from 99.9:0.1 to 51:49, 95:5 to 70:30, or 90:10 to 60:40. Lower levels of the blending agent may be useful in both HCCI/LTGC and SI engines.

In an embodiment, the majority portion fuel has a research octane number (RON) of 50 to 150, such as for example, 50 to 75, 80 to 90, or 92 to 125. In an embodiment, low-cost, low-octane fuels, may have their RON raised with the ketone blending agent, so that the RON of the blend is increased to a level that is useful in conventional commercial vehicles, or to higher octane levels for boosted or higher compression ratio engines. In an embodiment, the ketone compounds may also be used as a blending agent in fuels with higher octane ratings, such as currently available pump gasolines (regular, mid-grade and premium) to create a fuel with an octane rating above (or well above) current premium gasoline. This would enable the combined fuel to be effective with new or modified engines that have higher boost capacities and/or compression ratios than are currently widely used. In an embodiment, the ketone compound is added in an amount effective to raise the RON of the total blended fuel above that of the majority portion of the fuel by an amount sufficient to allow higher compression ratios and/or boost that in current engines. From the trends shown in the examples section, it is expected that RON of the fuel blend can be raised, for example, 5% to 100% higher, such as 10% to 50%, or 15% to 30%, higher than the RON of the majority portion of the fuel. In particular, the RON of a low octane fuel could be raised much higher with a substantial portion of the ketone compound fuel blend. In an embodiment, the ketone compound is added in an amount wherein the autoignition temperature at 1.1 to 4 bar intake pressure (boosted conditions) of the total blended fuel is 5 to 50% higher than the autoignition temperature of the majority portion of the fuel. Autoignition temperature as used herein is the temperature in the cylinder at the time of autoignition in Kelvin. For example, at 2.4 bar intake pressure the autoignition temperature of the total blended fuel may be 5% to 50% higher than the autoignition temperature of the majority portion of the fuel, such as 10% to 40%, or 15% to 30% higher.

In an embodiment, the ketone compound may be mixed with diesel fuel. Unexpectedly, despite the low autoignition temperature of the compounds, which normally would be counter-productive in a diesel fuel or diesel-type compression-ignition engine, when blended with a high cetane fuel, such as diesel fuel, the ketone compounds may be helpful in small amounts, such as the blending agent amounts referred to above, to facilitate low-temperature diesel combustion, which has been shown to have benefits for significant reductions in soot and NOx emissions, and in some cases to improve engine efficiency.

In certain embodiments for SI engines and compression ignition engines, including, for example HCCI or more generally, LTGC engines, fuel blends may comprise one or more of the ketone compounds disclosed herein mixed with a fuel selected from gasoline, diesel, alcohol fuel, other compounds such as thermo-chemically produced biofuels, renewable fuel, Fischer-Tropsch fuel, or mixtures thereof. In this embodiment, the fuels are more evenly balanced by volume. For example, the ketone compound may comprise a volume percentage of 25% to 90% of the total blended fuel by volume, such as, for example, 45% to 85%, or 51% to 80% and the gasoline, diesel, or alcohol fuel is 75% to 10%, 55% to 15%, or 49% to 20% by volume of the total fuel by volume. In embodiment, the ketone compound is present in a ratio with the gasoline, diesel, or alcohol fuel from 90:10 to 25:75, 85:15 to 45:55, or 80:20 to 51:49.

The blending of the gasoline, diesel, or alcohol fuel and the ketone compound can be performed at the pump, for example, as a blending agent blended into the fuel in the underground containers at the filling station. In another example, two separate tanks at the filling station would be filled. One with majority portion fuel, e.g. gasoline or diesel, and one with the ketone compound, and they would come together and be mixed in the pump, as the vehicle is fueled.

The blending agent can also be added directly to the gas tank of a vehicle that is separately filled with fuel. It could also be blended at the supplier just prior to shipment to the filling station.

In an embodiment the total fuel or blending agent consists essentially of the ketone compounds disclosed herein as the only engine knock reducing agent, and other components that do not materially affect the anti-knock properties of the total fuel or blending agent.

In an embodiment, the total fuel or blending agent is exclusive of 3-pentanone, which is a commonly used fuel tracer for laser induced fluorescence (LIF) experiments. In an embodiment, the fuel or blending agent is exclusive of cyclohexanone, which has a low cetane number (10). In an embodiment, the total fuel or blending agent is exclusive of an amide.

The ketone fuels and blending agents described herein may be used in various internal combustion engines. The cyclopentanone or derivative thereof can also be used as a blending agent in spark-ignition engines, and has particular benefits in boosted engines, such as turbo-boosted or supercharged engines because of its high resistance to autoignition property change under boosted conditions. The data herein indicates it may be superior to ethanol because of certain properties. The branched $C_4$ to $C_{10}$ acyclic ketone may be particularly useful in non-boosted spark-ignition engines. The ketone fuels described herein may also find uses as blending agents in diesel or other diesel-type compression-ignition engines. The neat ketones may be used in HCCI engines as shown in the examples, or, more generally LTGC engines or spark ignition engines. The branched $C_4$ to $C_{10}$ acyclic ketone fuel may be especially useful in high load HCCI applications. These engines are known in the art and do not require extensive description to those skilled in the art.

This reduction in the autoignition temperature of the fuel can also allow for internal combustion engines that are designed to have an increased boost and/or increased compression ratios. For example, the CR and/or intake-pressure boost (i.e. turbocharging or supercharging) may be increased by 5% to 50%, such as 10% to 40%, or 15% to 30% higher. For example, the CR units of the engine may be increased from 8:1, 9:1, or 10:1 to 15:1, such as, for example, up to 14:1, or up to 13:1. Boost levels might be increased from 1.5 bar to 4 bar (absolute), such as 2 bar to 3 bar (absolute), or 1 bar to 2.5 bar.

A method for powering an internal combustion engine, includes combusting a fuel to drive a piston in a cylinder of the engine. The fuel comprises a ketone-based fuel selected from a $C_4$ to $C_{10}$ branched acyclic ketone, cyclopentanone, or a derivative of cyclopentanone. In an embodiment, the ketone-based fuel is a majority portion of the total fuel used in the engine. In an embodiment, the method further comprises boosting the intake pressure of the engine to 1.1 to 4 bar, such as, for example, 2.4 to 3 bar, or 2.2 bar to 2.6 bar.

A section including working examples follows, but, as with the rest of the detailed description, should not be read to be limiting on the scope of the claims.

EXAMPLES

Two ketone compounds, 2,4-dimethyl-3-pentanone (DMPN) and cyclopentanone (CPN), were systematically investigated in an example HCCI engine. Fundamental engine experiments were conducted over a wide range of operating conditions to characterize the autoignition reactivity of the two fuels, and their autoignition sensitivity to variations in temperature and pressure. These characteristics were compared with neat ethanol and conventional-gasoline results from the same facility, some of which were reported in Yang, Y., Dec, J. E., Dronniou, N., Simmons, B. A., *Characteristics of Isopentanol as a Fuel for HCCI Engines*. SAE Int. J. Fuels Lubr., 2010. 3(2): p. 725-741, SAE Paper No. 2010-01-2164 and Sjöberg, M., Dec, J. E., *Ethanol Autoignition Characteristics and HCCI Performance for Wide Ranges of Engine Speed, Load and Boost*, SAE Int. J. Engines, 3(1): p. 84-106, SAE Paper No. 2010-01-8, 2010.

HCCI engine performance was tested for the maximum loads at naturally aspirated and boosted intake pressures.

Partially stratified HCCI combustion was also investigated to determine the potential of utilizing the unique autoignition properties of these fuels to improve the performance of HCCI engines. As mentioned above, the fuel autoignition characteristics here obtained from fundamental HCCI experiments are not only useful for HCCI engines, but can also be applied to understand the autoignition behavior in conventional engines, for example, to understand the effects of charge temperature and pressure on fuel anti-knock characteristics in spark-ignition engines.

The HCCI engine used for the Examples was derived from a Cummins B-series six-cylinder diesel engine, which is a typical medium-duty diesel engine. FIG. 1(*a*) shows a schematic of the engine, which has been converted for single-cylinder operation by deactivating cylinders 1-5. The active HCCI cylinder is fitted with a compression-ratio (CR)=14 custom piston, as shown in FIG. 1(*b*), which provides an open combustion chamber with a large squish clearance and a quasi-hemispherical bowl. The engine specifications and some operating conditions are listed in Table 1.

Further specifications of the HCCI engine are listed in Table 1.

TABLE 1

| | |
|---|---|
| Displacement (single-cylinder) | 0.981 liters |
| Bore | 102 mm |
| Stroke | 120 mm |
| Connecting Rod Length | 192 mm |
| Geometric Compression Ratio | 14:1 |
| No. of Valves | 4 |
| IVO | 0° CA* |
| IVC | 202° CA* |
| EVO | 482° CA* |
| EVC | 8° CA* |
| Swirl Ratio | 0.9 |
| Fueling System | Fully Premixed/GDI |
| DI Injector | Bosch, 8-hole |
| Included Angle | 70° |
| Hole Size | Stepped-hole, min. hole dia. = 0.125 mm |
| Injection Pressure | 120 bar |
| Coolant/Oil Temperature | 100° C. |

*0° CA is taken to be TDC intake. The valve-event timings correspond to 0.1 mm lift.

The engine was set up to allow both premixed fueling and direct fuel injection (DI). The premixed fueling system, shown at the top of the schematic in FIG. 1(*a*), includes of a gasoline direct injector (GDI) mounted in an electrically heated fuel-vaporizing chamber and appropriate plumbing to ensure thorough premixing with the air and exhaust gas recirculation (EGR) upstream of the intake plenum. This system supplies all the fuel for the fully premixed combustion and ≥60% of fuel for the partially stratified combustion. The DI fueling is via another GDI injector (Bosch, 8-hole) mounted centrally in the cylinder head. DI fueling supplies ≤40% of fuel for partially stratified combustion. A positive displacement fuel flow meter was used to determine the total amount of fuel supplied.

The intake air was supplied by an air compressor and precisely metered by a sonic nozzle. For operation without EGR, the air flow was adjusted to achieve the desired intake pressure, as measured by a pressure transducer on the intake runner. For operation with EGR, the air flow was reduced and the valve on the EGR line was opened. The exhaust back-pressure throttle valve was then adjusted to produce enough EGR flow to reach the desired intake pressure. This typically resulted in the exhaust pressure being about 2 kPa greater than the intake pressure. For consistency, the back pressure was maintained at 2 kPa above the intake pressure, even when EGR was not used.

When EGR was used, an equivalence ratio based on total charge mass, rather than air alone, was used, which is called $\phi_{in}$. It is defined as shown in formula I:

$$\phi_m = \frac{(F/C)}{(F/A)_{stoich}} \tag{I}$$

where F/C is the mass ratio of fuel and total inducted charge gas (i.e. fresh air and EGR), and $(F/A)_{stoich}$ is the mass ratio of stoichiometric fuel/air mixture for complete combustion. This provides a convenient and consistent way to compare data with the same supplied energy content per unit charge mass (i.e., the same dilution level) for operating conditions with different fuels and different EGR levels. Note that $\phi_m$ is the same as the conventional air-based $\phi$ when no EGR is used. For all conditions presented, the air-based $\phi$ is <1, so combustion is never oxygen limited.

The intake tank and plumbing were preheated to 50-60° C. to avoid condensation of the fuel or water from the EGR gases. The intake temperature was precisely controlled by an auxiliary heater mounted close to the engine. The cooling water and lubricating oil were maintained at 100° C. during the tests. All data were taken at an engine speed of 1200 rpm except for the speed sweep test.

Cylinder pressure was measured with a piezoelectric transducer (AVL QC33C) mounted in the cylinder head approximately 42 mm off center. The pressure transducer signals were recorded at ¼° crank angle (CA) increments for 100 consecutive cycles. The cylinder-pressure transducer was pegged to the intake pressure near bottom dead center (BDC) where the cylinder pressure reading was virtually constant for several degrees. Intake temperatures were monitored using thermocouples mounted in the two intake runners close to the cylinder head. For all data presented, 0° CA is defined as top dead center (TDC) intake (so TDC compression is at 360°). This eliminates the need to use negative crank angles or combined bTDC, aTDC notation.

The crank angle of the 50% burn point (CA50) was used to monitor the combustion phasing on the fly during the experiment. CA50 was determined from the cumulative apparent heat-release rate (AHRR), computed from the cylinder-pressure data (after applying a 2.5 kHz low-pass filter). The start of heat release was set at the minimum point on the AHRR curve before the main heat release peak. Computations of CA50 were performed for each individual cycle, disregarding heat transfer and assuming a constant ratio of specific heats ($\gamma=c_p/c_v$). The average of 100 consecutive individual-cycle CA50 values was then used to monitor CA50 and for the CA50 values reported. For cases where the pre-ignition heat release rates were of particular interest, the 10% burn point (CA10) was monitored instead. The individual-cycle based method was also used to analyze the maximum pressure rise rates from combustion and to calculate ringing intensity as described by Eng in Characterization of Pressure Waves in HCCI Combustion. SAE Paper No. 2002-01-2859, 2002. The ringing intensity was kept ≤5 $MW/m^2$ to prevent engine knock.

A second method of computing the heat release rate (HRR) was used for detailed HRR-curve analysis. Here, the heat release rate was computed in a more refined way from the ensemble-averaged pressure trace (with the 2.5 kHz low-pass filter applied), using the Woschni correlation for heat transfer (see Heywood, J. B., Internal Combustion Engine Fundamentals. 1988, New York: McGraw-Hill) and a variable $\gamma$ which updates as a function of burn fraction. In using the Woschni correlation, the main coefficient, C, and a coefficient in the gas velocity term, $C_2$, were adjusted for each combustion condition so that the heat release rate is zero before and after the combustion. Consistent values for the C and $C_2$ were used at comparable operating conditions. Using the ensemble-averaged pressure trace has benefits from the standpoint of reduced noise on the heat-release traces. On the other hand, it can lead to overestimated burn durations if the cycle-to-cycle variations are large. However, for the condition where this HRR analysis was applied, the phasing was fairly stable with the standard deviation of CA10 over 100 fired cycles averaging <1.2° CA and the standard deviation of the gross indicated mean effective pressure ($IMEP_g$)<2%.

Exhaust emissions data were acquired with the sample being drawn just downstream of the exhaust plenum using a heated sample line (see FIG. 1*a*). CO, $CO_2$, HC, $NO_x$, and $O_2$ levels were measured using standard exhaust-gas analysis equipment. Smoke measurements were also made with an automated smoke meter for partial stratified combustions.

The ketone compounds used in these Examples were obtained from Sigma-Aldrich (purities: CPN≥99%, DMPN=98%). The relevant physiochemical properties for HCCI Combustion are shown in Table 2, along with those of gasoline and ethanol. Both ketones are clear colorless liquids at room temperature.

TABLE 2

| | 2,4-Dimethyl-3-pentanone | Cyclo-pentanone | Ethanol | Gasoline |
|---|---|---|---|---|
| Formula | $C_7H_{14}O$ | $C_5H_8O$ | $C_2H_6O$ | $C_{6.83}H_{13.7}$[a] |
| Molecular Weight, g/mol | 114.2 | 84. 1 | 46.1 | 95.2 |
| Boiling Point, ° C. | 125.4 | 130.5 | 78.3 | $T_{10}$ = 59<br>$T_{50}$ = 93<br>$T_{90}$ = 145 |
| Density at 20° C., g/cm$^3$ | 0.8108 | 0.9487 | 0.7893 | 0.7460 |
| Lower Heating Value (LHV), gas, MJ/kg | 36.22 | 32.60 | 27.75 | 43.47 |
| A/F stoichiometric (kg/kg) | 12.02 | 10.61 | 9.00 | 14.8 |
| LHV for stoichiometric charge, MJ/kg | 2.782 | 2. 808 | 2.683 | 2.734 |
| Heat of Vaporization at 25° C., kJ/kg | 363.5 | 507.9 | 920 | 324[b] |
| $\Delta H_{vap,\ 25°\ C.}$ for stoichiometric charge, kJ/kg | 27.7 | 43.5 | 92.0 | 20.1[b] |
| Research octane number (RON) | — | — | 107 | 90.8 |
| Motor octane number (MON) | — | — | 89 | 83.2 |
| Antiknock Index, (RON + MON)/2 | — | — | 98 | 87.0 |

[a]Estimated from fuel hydrocarbon composition.
[b]Data for isooctane.

Autoignition of the two ketone compounds were studied in a number of operating parameter sweeps in which wide ranges of engine speed, intake pressure, intake temperature, combustion phasing, and equivalence ratio were examined. Although the performance data are not reported in each case, all data for the Examples were collected under the conditions where the HCCI combustion was clean ($ISNO_x$<0.1 g/kWh, no soot), efficient (combustion efficiency >96%, based on CO and hydrocarbon emissions), stable (COVIMEP <2%), and non-knocking (ringing intensity ≤5 MW/m2), unless otherwise noted.

Example 1: HCCI Reactivity—Engine Speed vs. $T_{in}$ Sweep

HCCI combustion is initiated by the early autoignition reactions at low and intermediate temperatures, which trigger the main heat-release event. A fuel with higher autoignition reactivity will reach hot ignition sooner than a fuel with lower reactivity, for otherwise equal conditions. Therefore, combustion timing is often used to compare autoignition reactivity of different fuels in HCCI engines. Alternatively, autoignition reactivity can be compared based on the adjustments that are required to reach a prescribed combustion timing. For example, a fuel with lower autoignition reactivity would need a higher intake temperature, a higher intake pressure, or less EGR, etc., in order to give a same combustion timing as a more reactive fuel, since the autoignition kinetics are accelerated by increasing reaction temperature, pressure, and oxygen concentration, etc.

Figure 2:
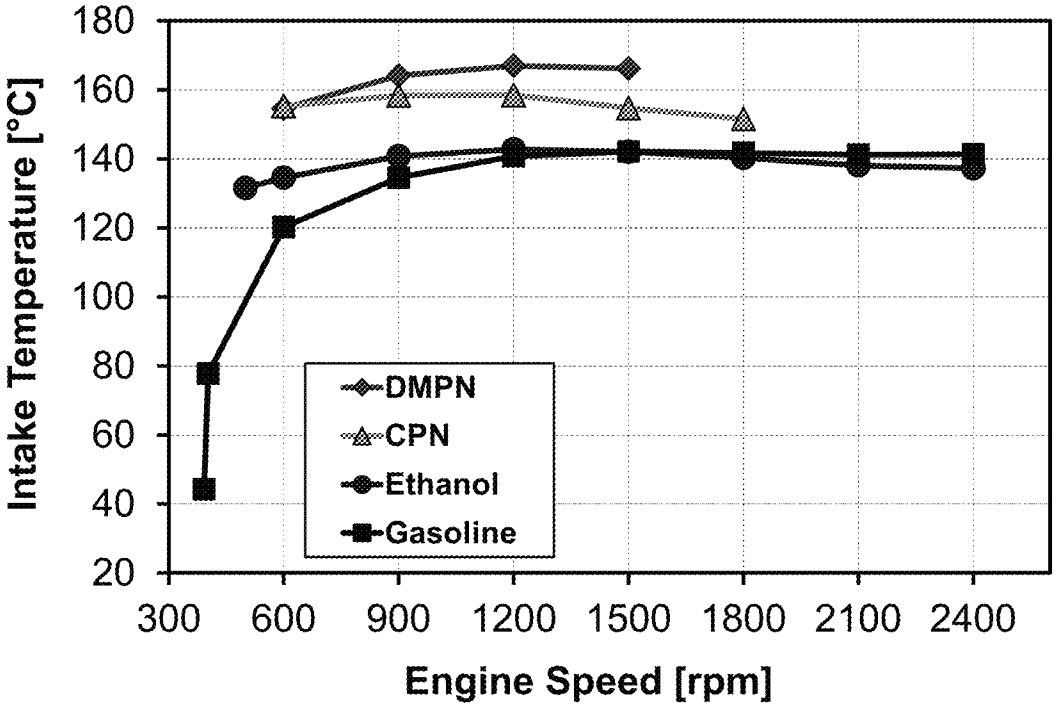
FIG. 2 is a graph showing engine speed vs. $T_{in}$ sweeps for example fuels.

In Example 1, the HCCI autoignition reactivity of the two ketone fuels, DMPN and CPN, is compared in an engine speed vs. intake temperature ($T_{in}$) sweep. The results are shown in FIG. 2, together with those for gasoline and ethanol. During this test, the combustion timing, equivalence ratio, and intake pressure ($P_{in}$) were kept constant, so that CA50=372° CA (12° CA after TDC compression), $\phi$=0.38, and $P_{in}$=1 bar. No EGR was used at these naturally aspirated conditions, and $T_{in}$ was adjusted to maintain the constant CA50. At the low speed range (<about 1200 rpm), a higher $T_{in}$ is typically required with increasing speed (FIG. 2). This is because higher temperatures accelerate the reaction rate, which compensates for the reduced time available for autoignition reactions as speed increases. At the high speed range (>about 1200 rpm), however, more pumping work is required to induct the charge in a shorter amount of time, which causes a stronger dynamic heating effect that raises the temperature of the charge mixture significantly more than at lower speeds. Also, higher engine speeds allow less time for heat transfer. As a result of these two effects, less external heating is required, even though the charge temperature must continue to increase with engine speed to maintain the same CA50. Therefore, the required $T_{in}$ hardly changes or even drops slightly with increasing speed.

At a given engine speed, FIG. 2 shows that the intake temperatures required for the two ketones to reach a given CA50 are consistently higher than those of gasoline and ethanol, indicating a lower HCCI reactivity for the ketone compounds at these conditions. Unlike gasoline, neither ketone could achieve successful HCCI combustion at the desired combustion timing with engine speed less than 600 rpm. The steep $T_{in}$ drop with gasoline at <600 rpm is due to the onset of two-stage ignition at these speeds, and the low-temperature heat release (LTHR) significantly reduces the $T_{in}$ requirement. On the other hand, the two ketones and ethanol show single-stage ignition throughout the speeds tested. Attempts to operate at lower speeds and lower $T_{in}$ with these fuels were not successful (fuel failed to autoignite).

Between the two ketones, the acyclic (open chain) ketone (DMPN) requires a higher $T_{in}$, but the cyclic ketone (CPN) shows a steeper $T_{in}$ drop for engine speeds >1200 rpm. The latter suggests that the autoignition of CPN is more sensitive to the temperature increase resulting from dynamic heating, which is confirmed in the Example 2 by the temperature sensitivity test.

Examples 2-5: Autoignition Sensitivity to Temperature—$T_{in}$ Sweep

Example 2

In Example 2, a $T_{in}$ sweep is performed to determine autoignition sensitivity to temperature. Temperature can affect the autoignition process and HCCI combustion in different ways due to the non-linear, and for some cases, non-monotonic effects of temperature on autoignition kinetics. For example, from FIG. 2 one would expect very different temperature effects on gasoline autoignition at 400 rpm and at 1200 rpm.

1200 rpm was considered the standard (control) speed for this example, as well as other examples disclosed herein. Accordingly, in Example 2 a $T_{in}$ sweep was conducted at this speed to determine the sensitivity of hot-ignition timing, as indicated by 10% burn point (CA10), to variations in $T_{in}$ (i.e. the $T_{in}$ sensitivity) for the different fuels.

Figure 3:
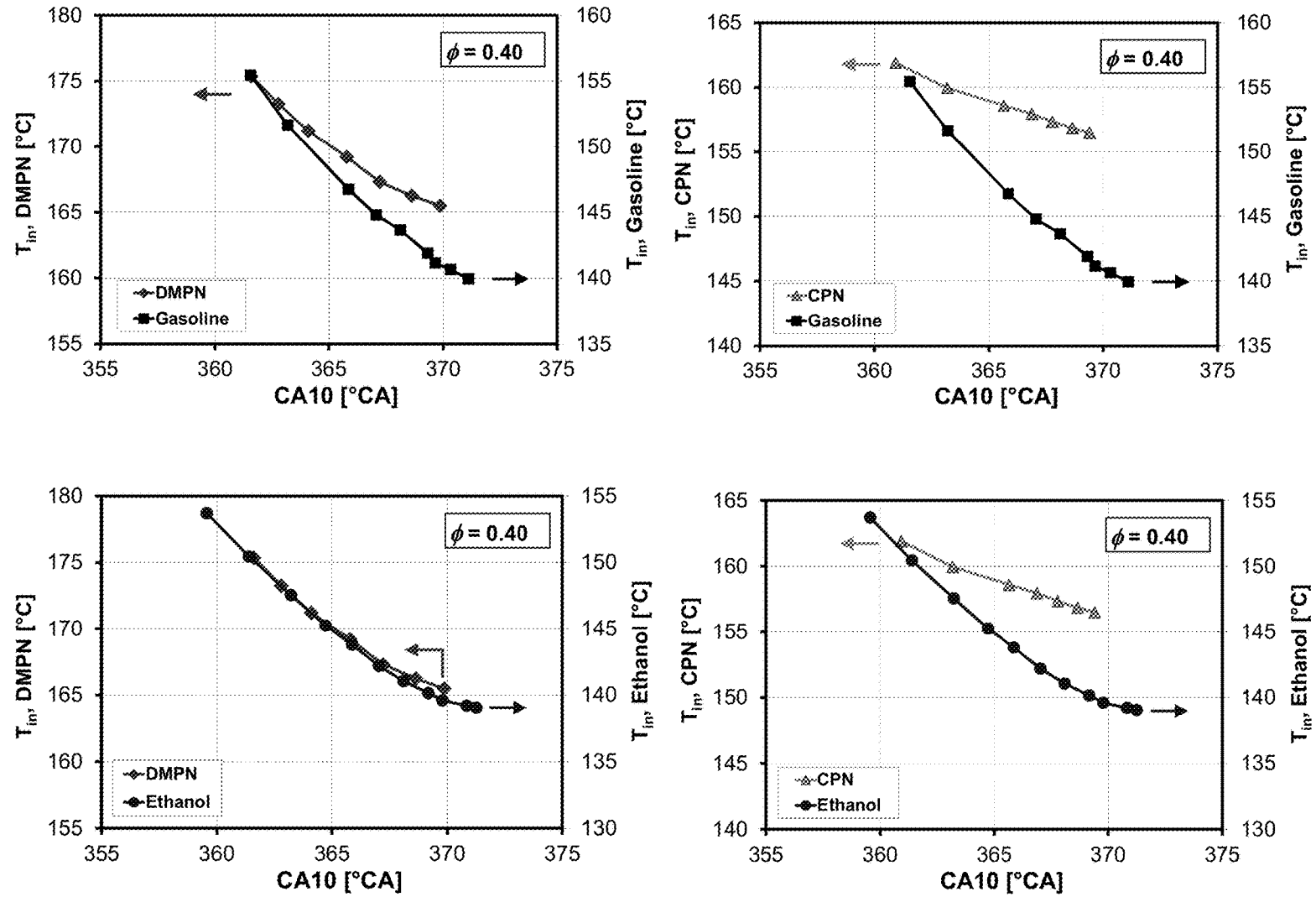
FIG. 3 is graph showing $T_{in}$ versus CA10 sweeps for the example fuels.

FIG. 3 shows a comparison of the temperature sensitivity of the two ketone fuels with gasoline and ethanol based on the $T_{in}$ sweep data. The tests were conducted by varying intake temperature and maintaining a constant equivalence ratio ($\phi$=0.4) and intake pressure ($P_{in}$=1 bar). No EGR was used during this process. Note that the two $T_{in}$-axes in each plot cover the same range of temperature (25° C.); thus the temperature sensitivity, represented by the slope of the curve, can be directly compared among the fuels. At these conditions, reducing $T_{in}$ reduces the pre-ignition reaction rates (i.e., the rates of the early reactions occurring at low and intermediate temperatures that drive the charge into hot ignition and thermal runaway), retarding the ignition timing for all fuels. However, the sensitivity of CA10 to a given reduction of $T_{in}$ is fuel dependent. As shown in FIGS. 3(*a*) and 3(*b*), the two ketone fuels are much more temperature sensitive than gasoline. For example, CPN requires only a 3.5° C. reduction of $T_{in}$ for the CA10 to retard from 363° CA to 369° CA, but gasoline requires over 10° C. reduction of $T_{in}$ for a similar CA10 retard. A comparison of FIGS. 3(*a*) and 3(*c*) shows that ethanol also has a higher $T_{in}$ sensitivity than gasoline, and it is just slightly less sensitive than DMPN (FIG. 3(*c*)). On the other hand, the $T_{in}$ sensitivity of CPN is well above that of ethanol, making it the most thermally sensitive of all the fuels tested.

Example 3

Figure 4:
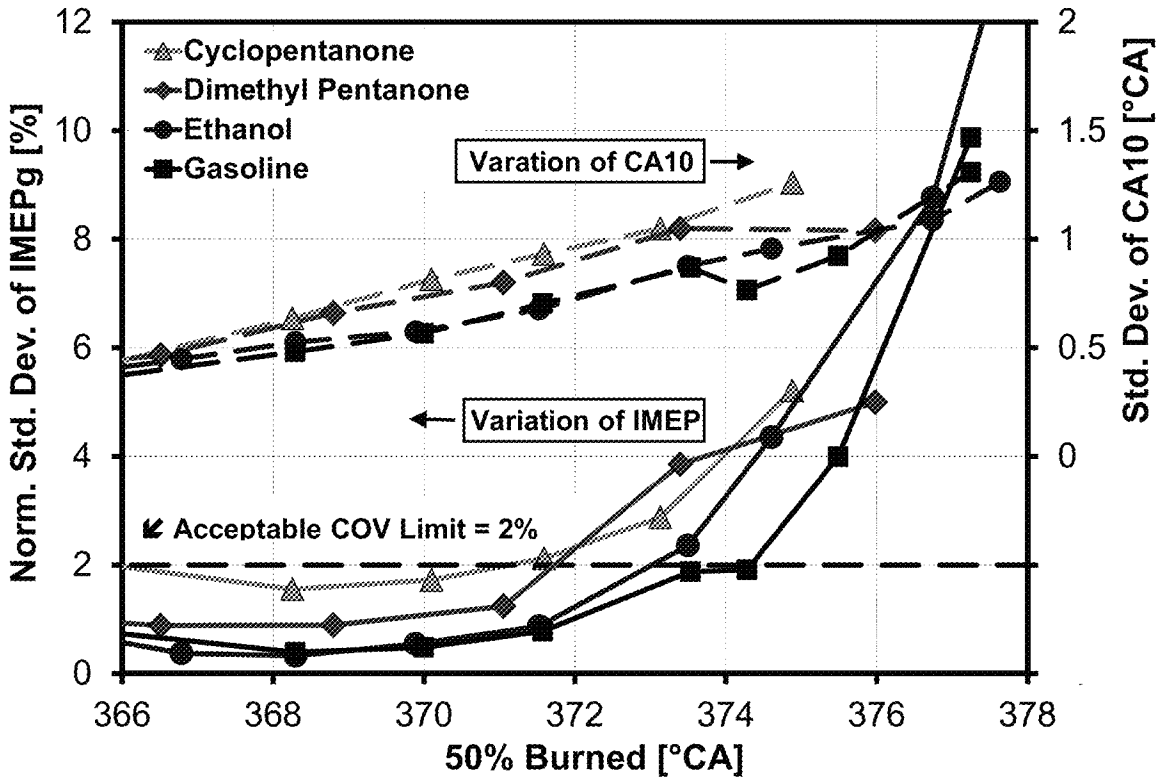
FIG. 4 is graph showing combustion stability as a function of CA50 for the example fuels.

The stronger temperature-sensitivity of the ketone fuels suggests that their autoignition will be more susceptible to random variations in charge temperature, and thus greater cycle-to-cycle variation of their ignition timing would be expected. This is confirmed in FIG. 4, which shows a comparison of combustion stability as a function of CA50, using data from the same $T_{in}$-sweeps as in FIG. 3. In FIG. 4, both ketones show larger variations in CA10 than gasoline or ethanol as CA50 is retarded (which is frequently done to prevent knock), except for DMPN at the most retarded point. (At this point combustion was near misfiring and became difficult to control. The overall combustion stability actually observed was worse than those indicated by the CA10 and IMEP variations in FIG. 4.) Similar results are observed for the variation of $IMEP_g$ in FIG. 4, even though $IMEP_g$ variations are a secondary effect resulting from the sensitivity of the autoignition timing to temperature variations.

Example 4

The origin of the temperature sensitivity of autoignition has been attributed to the magnitude of the temperature rise rate (TRR) just prior to hot ignition. For conditions producing higher TRRs, small variations in the charge temperature cause only small variations in hot-ignition timing (i.e. low temperature-sensitivity), resulting in a more stable $IMEP_g$ from cycle to cycle, whereas the opposite is true for conditions producing a low TRR. For a given combustion timing, the TRR prior to hot ignition is controlled by the heat-release rate (HRR) prior to hot ignition. This HRR is termed the intermediate temperature heat release (ITHR) rate, since it occurs at temperatures intermediate between hot ignition and the well-known early low-temperature heat release (LTHR). A higher ITHR-rate results in a higher TRR by more effectively counteracting the rate of piston-expansion cooling, thus giving a lower temperature sensitivity. Additionally, as CA50 is retarded (as in FIG. 4), the increased rate of expansion cooling at later CA50s reduces the TRR, increasing temperature sensitivity and making combustion less stable for all fuels (i.e. greater cycle-to-cycle variations in CA10 and $IMEP_g$). However, fuels having more ITHR can counteract more expansion cooling, and thus maintain sufficiently high TRRs to prevent excessive temperature sensitivity and maintain acceptable CA10 and $IMEP_g$ stability with greater CA50 retard. This theory, based essentially on the thermal effect of pre-ignition reactions, has been successfully used to explain the temperature sensitivities for primary reference fuel (PRF) mixtures and biofuels.

However, pre-ignition reactions not only release heat, which raises the charge temperature and accelerates the reactions, but they also produce radical pools that help drive the reactions smoothly into hot ignition, a chemical effect. The relative importance of the thermal and chemical effects will depend on the fuel type and the specific intermediate-temperature reactions involved. Past success based on the thermal effect alone indicates that differences in the chemistry effect between fuels are small for many typical fuels. However, fuels with sufficiently different structure, such as DMPN studied here, it may be helpful to also consider chemical effects.

Figure 5:
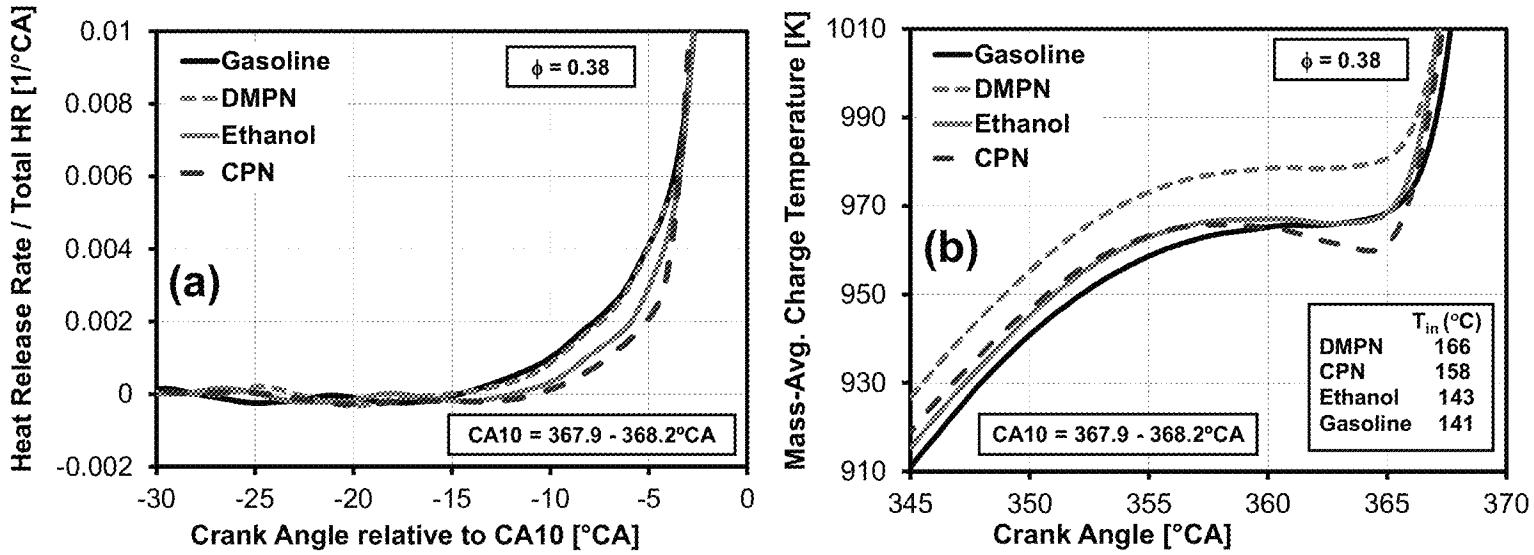
FIG. 5 is a set of graphs showing: (a) pre-ignition heat release rates (ITHR) and (b) temperature rise rates versus crank angle for the example fuels.

To this end, the ITHR and TRR of the four fuels are compared in FIG. 5. FIG. 5(*a*) shows the pre-ignition heat release rates (HRRs), i.e. the ITHR, and FIG. 5(*b*) shows the temperature rise rates. Test conditions were $\phi$=0.38, $P_{in}$=1.0 bar, CA10=368° CA. $T_{in}$ was used to maintain an essentially constant CA10 for the different fuels as shown in the inset. The pre-ignition HRRs are normalized by the respective total HRRs to eliminate differences in fuel energy input.

CPN, which has the strongest temperature sensitivity of the tested fuels, produced the lowest ITHR and consequently the lowest TRR prior to the heat release take-off at about 365° CA. Results for gasoline and ethanol are also consistent with this theory, with gasoline showing the highest ITHR and TRR and least temperature sensitivity (See FIG. 3), and ethanol showing an intermediate level of ITHR and TRR corresponding to its temperature sensitivity relative to the other fuels. (It is noteworthy that the ITHRs of CPN and to a lesser degree, ethanol, are so weak that the mass-averaged TRRs are negative just prior to hot ignition. Since the reactions do progress to hot ignition, either there are local regions where the TRR remains positive or the chemical effects such as radical production, must be sufficient to carry the reactions forward to hot ignition despite the temperature drop.)

DMPN, the second most temperature-sensitive fuel, produced a relatively high ITHR and TRR, similar to gasoline and higher than ethanol, which does not fit into the above theory since it is more temperature sensitive (although only slightly so as seen in FIG. 3) and shows greater cycle-to-cycle variation than ethanol (FIG. 4). Such discrepancy could be due to the chemical effect above discussed for the pre-ignition reactions. That is, although pre-ignition reactions of DMPN generate relatively large amounts of heat, the radicals produced from these reactions could be very sensitive to the temperature variations in the subsequent reactions leading to hot ignition. However, some unique autoignition characteristics were observed for DMPN, as further shown in the following examples.

Example 5

The high temperature-sensitivity of the ketone fuels (FIG. 3) and the resulting poor combustion stability at retarded combustion phasing (FIG. 4) suggest that high-load HCCI operation may be limited for both ketone compounds when used as neat fuels in naturally aspirated conditions. However, intake pressure boosting may overcome these limitations and is an effective way to extend HCCI engines to high-load operation. However, pressure has a significant impact on HCCI autoignition and combustion processes. For example, significant enhancements of ITHR have been observed for a conventional gasoline with higher intake pressures.

Figure 6:
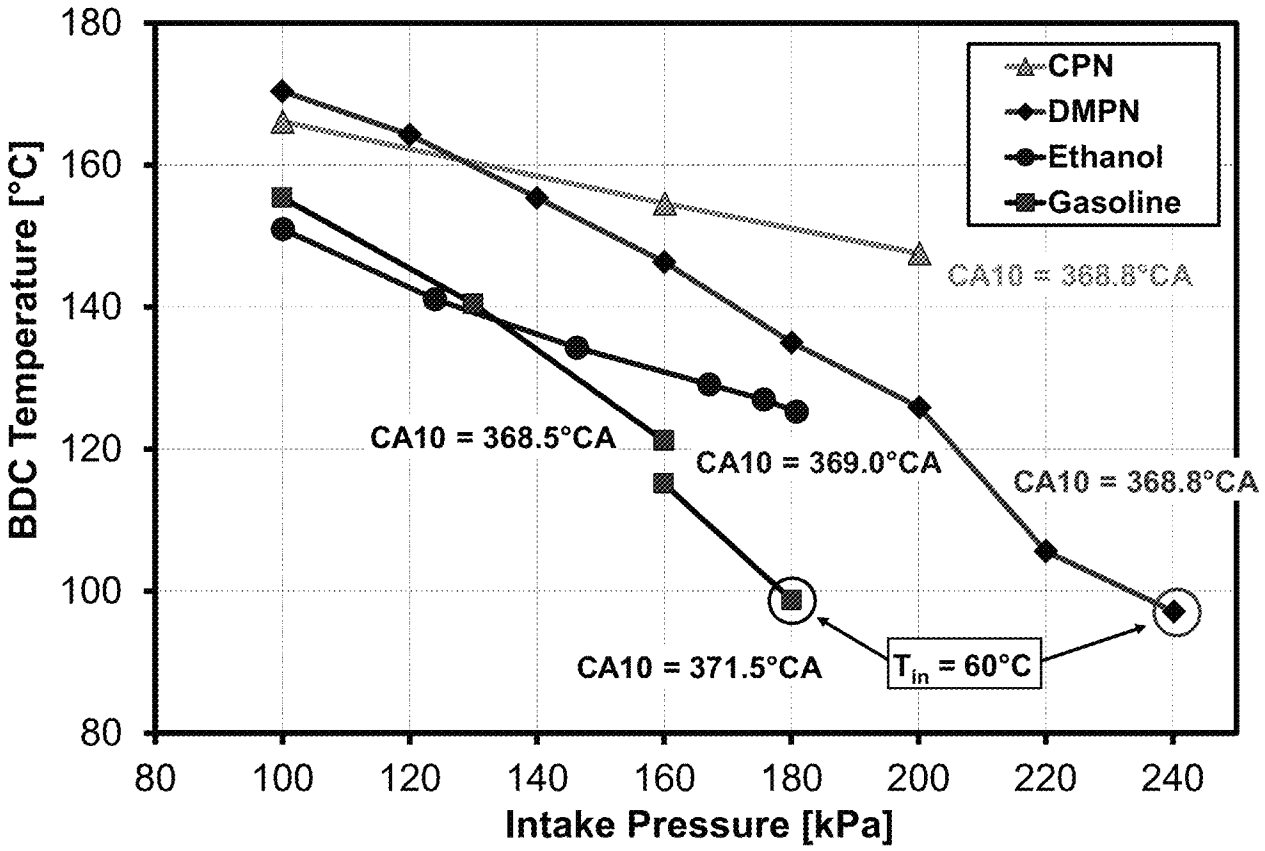
FIG. 6 is a graph showing BDC temperature versus $P_{in}$ for the example fuels.

In Example 5, intake pressure sweeps were conducted to study the effects of intake boost (pressure) on autoignition and combustion for the ketone fuels. FIG. 6 shows the correspondence between $P_{in}$ and $T_{BDC}$ (BDC temperature at the start of compression) at a fixed equivalence ratio and ignition timing, except as noted in the figure caption. No EGR was used during these sweeps except for the highest-boost points for gasoline ($P_{in}$=1.8 bar, 23% EGR) and DMPN ($P_{in}$=2.4 bar, 7% EGR) ($\phi$=0.38 except for ethanol with $\phi$=0.40). A later CA10 was used for gasoline at $P_{in}$=1.6 and 1.8 bar to prevent engine knock. As intake pressure increased, the enhanced reaction rates required that $T_{in}$ be reduced to maintain constant CA10. The magnitude of this pressure effect varied between the four fuels. A steeper drop in $T_{BDC}$ indicated a greater pressure sensitivity, which occurred because the fuel autoignition chemistry (i.e. the low- and intermediate-temperature reactions) was enhanced by the increased pressure to a larger extent, so less intake heating was required for the given CA10.

In the results, gasoline showed the highest pressure sensitivity among the four fuels, which can be attributed to its paraffin constituents whose autoignition rates are known to be significantly promoted by pressure. The sweep does not extend beyond 1.8 bar for gasoline because the intake temperature at this pressure has already reached the minimum intake temperature of 60° C., selected to prevent potential fuel (and EGR water if used) condensation. DMPN showed a $T_{BDC}$-reduction trend similar to gasoline, although it is somewhat less steep for $P_{in}$=1.0-1.8 bar. This might be caused by the open chain structure of DMPN which preserves some characteristics of paraffins autoignition. Since the $T_{in}$ ($T_{BDC}$) of DMPN is considerably higher than gasoline at $P_{in}$=1.0 bar, the $T_{in}$ of DMPN does not drop to 60° C. until $P_{in}$=2.4 bar. In contrast, the slope for $T_{BDC}$ reduction with $P_{in}$ is much lower for ethanol, and even more reduced for CPN, indicating that their autoignition chemistries are not enhanced by pressure nearly as much. As a result, the $T_{in}$ of ethanol and CPN could not be reduced to 60° C. for the range of $P_{in}$ tested.

Examples 6 and 7: Autoignition Sensitivity to Pressure—$P_{in}$ Sweep

Example 6

Figure 7:
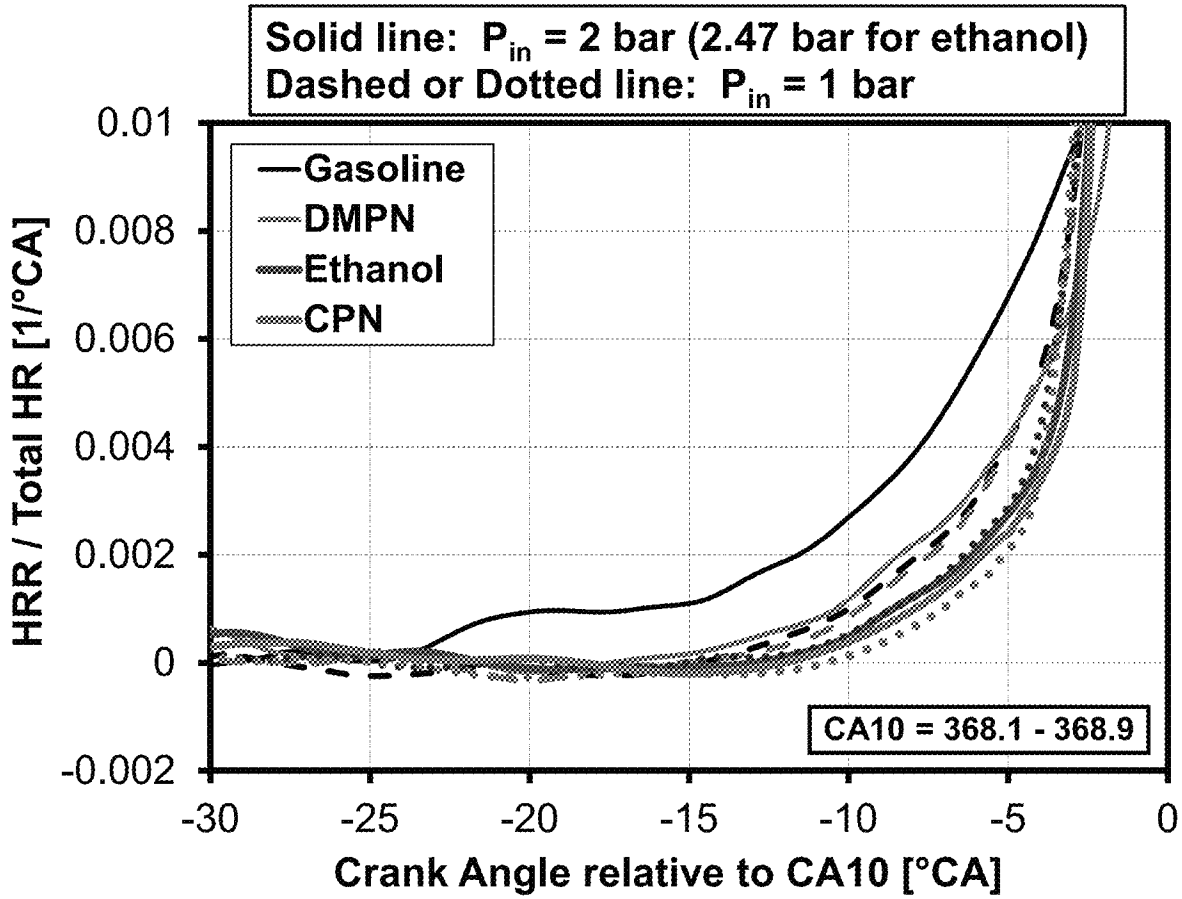
FIG. 7 is a graph showing ITHR versus crank angle relative to CA10.

The pressure effect on autoignition can also be determined from a comparison of the pre-ignition HRRs. In FIG. 7, the ITHR of the four fuels are compared at $P_{in}$=1.0 and 2.0 bar (the 1.0 bar data are the same as in FIG. 5(*a*)).

The ITHR of gasoline is significantly enhanced by the pressure increase. As a result, the required $T_{in}$ drops quickly as the pressure increases. On the other hand, the pressure appears to have little effect on the ITHRs of ethanol and CPN, which remain nearly unchanged from 1.0 to 2.0 bar for both fuels. This trend is consistent with their weak $T_{BDC}$ dependence on pressure, as seen in FIG. 6. To avoid excessive knock, different equivalence ratios were used in FIG. 7 in several cases ($\phi$=0.38, except $\phi$=0.40 for ethanol at 1.0 bar, $\phi$=0.355 for ethanol at 2.47 bar, and $\phi$=0.32 for gasoline at 2.0 bar). However, the effect of $\phi$ on ITHR was found insignificant with the ITHR being normalized by the total heat releases (as in FIG. 7). Table 2 shows $T_{in}$ data at 1.0 and 2.0 bar $P_{in}$ corresponding to FIG. 7.

TABLE 2

| $P_{in}$ | $T_{in}$ (° C.) | | | |
|---|---|---|---|---|
| (bar) | DMPN | CPN | Ethanol | Gasoline |
| 1.0 | 166 | 158 | 141 | 141 |
| 2.0 | 93 | 119 | 94* | 61 |

The behavior of DMPN again does not align with the trends of the other fuels. The autoignition reactivity of DMPN increases significantly with pressure, as evident by the slope of the $T_{BDC}$ vs. $P_{in}$ curve in FIG. 6 being similar to that of gasoline. However, unlike gasoline, such behavior is not accompanied by an ITHR enhancement. The ITHR of DMPN increases only marginally as $P_{in}$ is increased from 1.0 to 2.0 bar despite about 45° C. reduction in $T_{BDC}$ (FIG. 7). This discrepancy indicates that DMPN appears to have unique autoignition chemistry compared to typical hydrocarbon-fuel compounds.

Example 7

Figure 8:
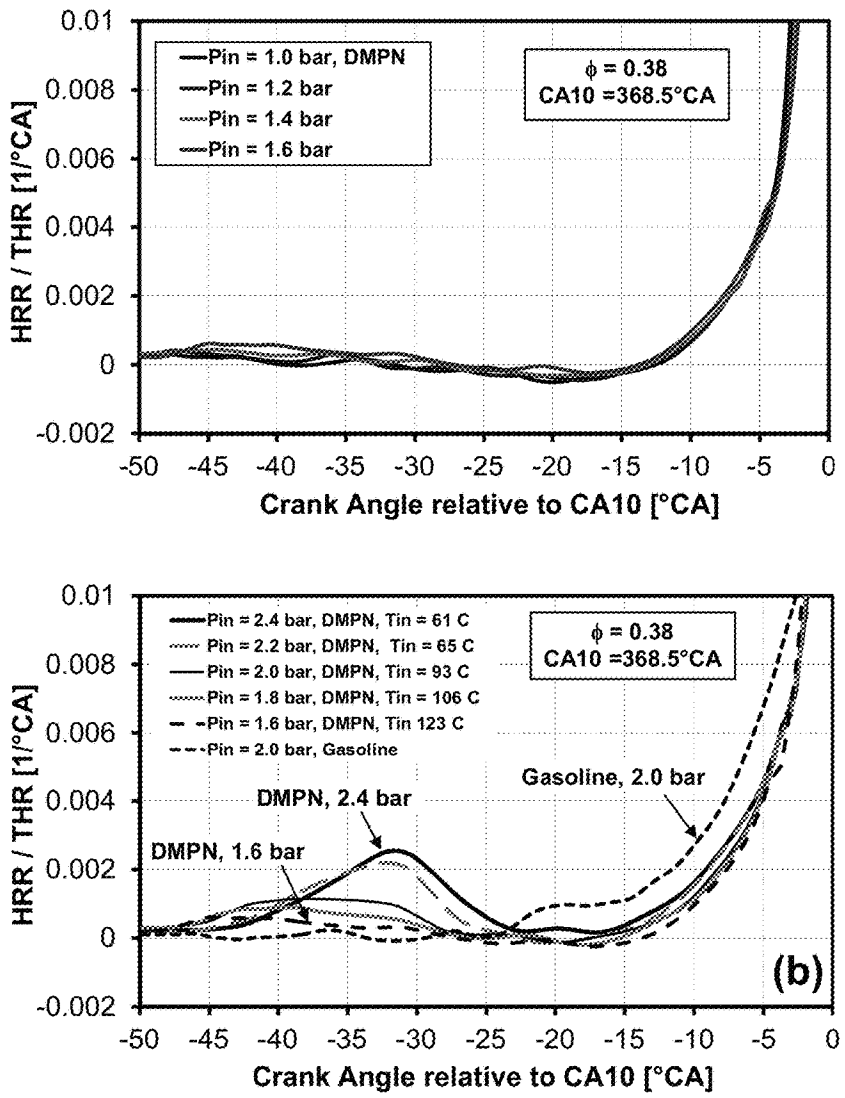
FIG. 8 is a graph showing pressure effects on ITHR of DMPN shown versus crank angle relative to CA10.

Further evidence of DMPN's unique autoignition chemistry is shown in FIG. 8, which has more-detailed pre-ignition HRR curves for the DMPN $P_{in}$-sweep data in FIG. 6. From $P_{in}$=1.0 to 1.6 bar, FIG. 8(*a*) shows that the ITHR remains essentially constant despite the rapid drop in $T_{BDC}$ (or $T_{in}$ as indicated). (The graph lines for all $P_{in}$ levels are essentially overlapping and indistinct.) Starting from $P_{in}$=1.8 bar, however, some unusual low-temperature heat release occurs early in the cycle and becomes stronger and slightly retarded as $P_{in}$ increases (FIG. 8(*b*). This LTHR is substantially different from the typical LTHR produced by hydrocarbon fuels such as gasoline. In FIG. 8(*b*), the LTHR of DMPN occurs 10 to 15° CA earlier than that of gasoline (note that gasoline shows a small amount of LTHR at about −20° CA relative to CA10), so the temperature/pressure histories up to the time of the LTHR are different for the two fuels. Also, for DMPN, the LTHR promotes far less subsequent ITHR compared to gasoline. As seen in FIG. 8*b*, although the magnitude of DMPN's LTHR (at 2.4 bar) is significantly larger than that of gasoline (at 2.0 bar), the ITHR of DMPN remains much weaker than the ITHR of gasoline. These significant differences in the conditions and outcome of the pre-ignition processes strongly suggest that the LTHR and ITHR of DMPN are produced by very different autoignition chemistry compared to gasoline. These findings, combined with the $T_{BDC}$ vs. $P_{in}$ behavior shown in FIG. 6, indicate that comparing only the magnitude of ITHR does not reveal the all the relevant factors. The types and amounts of radicals produced along with the ITHR, which subsequently drive the charge into hot ignition, are unexpected factors as well.

The fundamental HCCI experiments of Examples 1-7 show the autoignition characteristics of the two ketone fuels. The cyclic ketone, CPN, is a low-reactivity fuel for HCCI combustion and its autoignition shows strong temperature sensitivity and very weak pressure sensitivity. These characteristics are consistent with its ITHR, which is the lowest among either the biofuels or the gasoline fuels that were tested. Overall, the autoignition behavior of CPN is very similar to ethanol, except that it is less reactive and has a higher $T_{in}$ sensitivity. This indicates it should have superior anti-knock properties when used as a blending agent for fuels used in boosted engines.

Examples 8-11: HCCI Performance—Maximum $IMEP_g$ for DMPN at $P_{in}$=1.0 and 2.4 bar

Example 8

Figure 9:
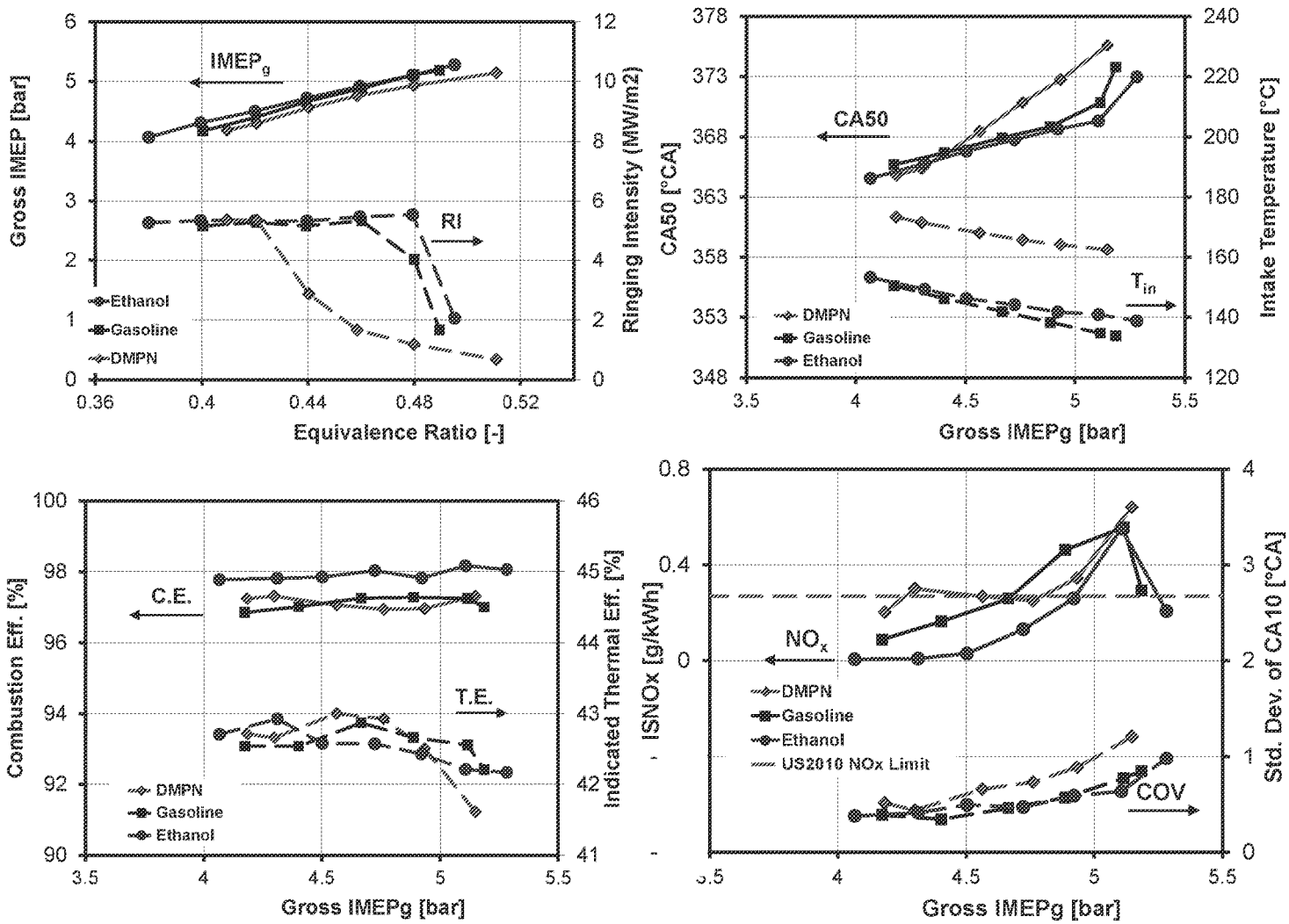
FIG. 9 is a set of graphs showing combustion performance of example fuels (at 1 bar) by: (a) IMEP and ringing intensity versus equivalence ratio; (b) CA50 and $T_{in}$ versus $IMEP_g$; (c) combustion and thermal efficiencies vs. $IMEP_g$; and (d) $NO_x$ emissions and standard deviation of CA10 vs. $IMEP_g$ with no EGR.

In Example 8, high-load HCCI operation with DMPN was investigated at naturally aspirated. The results for naturally aspirated operation ($P_{in}$=1.0 bar) are compared with newly obtained gasoline and ethanol data in FIG. 9, which shows the engine performance as a function of equivalence ratio or $IMEP_g$. Specifically, FIG. 9(*a*) shows $IMEP_g$ and ringing intensity vs. ϕ, FIG. 9(*b*) shows CA50 and $T_{in}$ vs. $IMEP_g$. FIG. 9(*c*) shows combustion and thermal efficiencies vs. $IMEP_g$. FIG. 9(*d*) shows $NO_x$ emissions and standard deviation of CA10 vs. $IMEP_g$. No EGR was used in Example 8.

The high-load limit was approached by first operating the engine at a relatively stable condition, and then gradually increasing the fueling rate and retarding CA50 as necessary to prevent excessive ringing, until reaching the knock/stability limit. During this process, $T_{in}$ was reduced to obtain the required CA50 retard, and no EGR was used. When the combustion was stable, CA50 was adjusted to obtain a constant ringing intensity of 5 $MW/m^2$, which is the maximum ringing intensity that still ensures knock-free operation. Setting CA50 in this manner gives the most advanced combustion phasing without knock, and thus the highest thermal efficiency. However, lower ringing intensities, produced by additional CA50 retard, were required at some conditions to achieve sufficiently stable combustion phasing.

As FIG. 9 shows, DMPN reached a similar maximum $IMEP_g$ of about 5.2 bar to gasoline and ethanol. Ringing intensities <5 $MW/m^2$ had to be used for DMPN at $IMEP_g$>4.5 bar in order to prevent knock runaway (FIG. 9(*a*), so the CA50 of DMPN is retarded relative to gasoline and ethanol (FIG. 9(*b*)). The higher knock-runaway tendency is likely caused by the higher intake temperatures required by DMPN (FIG. 9(*b*)), due to its lower autoignition reactivity at $P_{in}$=1 bar as observed in the speed sweep (FIG. 2). Also, these higher temperatures resulted in greater $NO_x$ formation, which can significantly promote autoignition when the threshold $NO_x$ level is reached in the residual gases. Note in FIG. 9(*d*) that the indicated specific $NO_x$ emissions ($ISNO_x$) for DMPN and gasoline are at similar levels, even though the CA50 of DMPN was more retarded and the ringing intensity is lower than 5 $MW/m^2$. Significantly higher $NO_x$ concentrations were observed for DMPN when more advanced CA50 were attempted to reach ringing of 5 $MW/m^2$, which could not be stabilized and led to knock runway.

The indicated thermal efficiency of HCCI combustion is compared for the three fuels in FIG. 9(*c*). Except at the high-load limit, DMPN shows similar thermal efficiency to gasoline and ethanol. Considering the more retarded CA50 and higher $T_{in}$ of DMPN, both of which likely reduce thermal efficiency, and with the combustion efficiency of DMPN being about the same as gasoline and ethanol (FIG. 9(*c*)), the similar thermal efficiency of DMPN to gasoline and ethanol seems unexpected. One possible factor might be the lower ringing intensity that reduces heat losses to cylinder walls for DMPN combustion. However, the relative significance of this and the above mentioned factors are unclear. It was also noted that DMPN showed larger variations in CA10, which was most likely due to the more retarded combustion phasing.

Despite these differences, the overall behavior of all three fuels is similar and typical of low-reactivity fuels, i.e. fuels requiring a high intake temperature, which limits the maximum $IMEP_g$ (due to a lower charge mass with the reduced density at higher temperatures) and produces relatively large amount of $NO_R$.

Example 9

Figure 10:
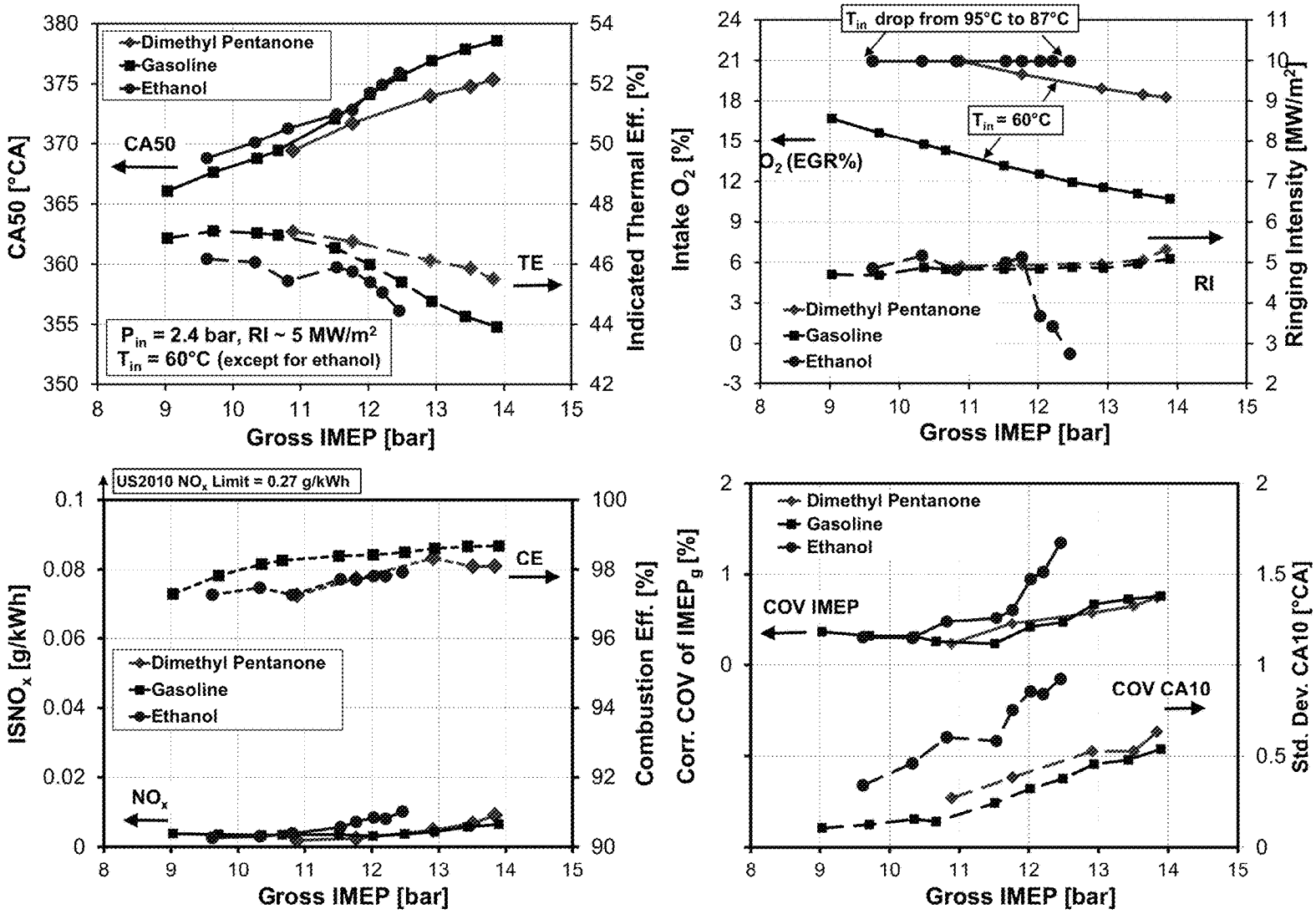
FIG. 10 is a set of graphs showing a comparison of HCCI combustion performance of example fuels at boosted (2.4 bar) intake pressure. Graph (a) shows CA50 and gross indicated thermal efficiency versus $IMEP_g$; graph (b) shows intake oxygen % and ringing intensity versus $IMEP_g$; graph (c) shows combustion efficiency and $NO_x$ emissions versus $IMEP_g$; and graph (d) shows cycle-to-cycle variations of CA10 and $IMEP_g$ versus $IMEP_g$.

The HCCI combustion performance at a significant boost pressure, 2.4 bar, was evaluated in Example 9 and the results are shown in FIG. 10. The same three fuels: DMPN, gasoline and ethanol were tested as in Example 8. The 2.4 bar boost pressure was selected primarily because the minimum intake temperature, 60° C., can be used for both DMPN and gasoline, although the required $T_{in}$ for ethanol is still above 60° C. (as indicated in FIG. 10(*b*)). As ϕm increases, the EGR level was increased for gasoline and DMPN to retard the combustion timing for knock control (i.e. to maintain the ringing intensity ≤5 $MW/m^2$). No EGR was used for ethanol, and the timing retard was achieved by reducing $T_{in}$, as was done at $P_{in}$=1 bar.

FIG. 10(*a*) shows CA50 and gross indicated thermal efficiency vs. $IMEP_g$. FIG. 10(*b*) shows intake oxygen % (indicative of EGR %) and ringing intensity vs. $IMEP_g$. FIG. 10 (*c*) shows combustion efficiency and $NO_x$ emissions vs. $IMEP_g$. FIG. 10(*d*) shows cycle-to-cycle variations of CA10 and $IMEP_g$ vs. $IMEP_g$.

In Example 9, DMPN reaches a maximum $IMEP_g$ of 13.8 bar, which is very close to the maximum $IMEP_g$ for gasoline (13.9 bar) and significantly higher than that of ethanol (12.5 bar). The similar maximum loads for DMPN and gasoline are somewhat unexpected given that DMPN does not allow as much combustion retard as gasoline to limit the ringing intensity, due to its relatively low ITHR. As shown in FIG. 10(*a*), the CA50 at the load limit is 375.4° CA for DMPN, and it is 378.6° CA for gasoline (375.9° CA for ethanol). Since CA50 is considerably less retarded for DMPN but still with ≤5 $MW/m^2$ ringing intensity (FIG. 10(*b*)), it must have another HRR-control mechanism(s) that prevents excessive ringing with increased load, as discussed in the next paragraph. Note that the maximum load for ethanol is lower because less charge mass is inducted due to the higher $T_{in}$, and because fueling cannot be further increased while maintaining a ringing intensity ≤5 $MW/m^2$: CA50 cannot be further retarded with good stability due to ethanol's low ITHR.

This additional HRR-control mechanism for DMPN is likely its high temperature-sensitivity. It is known that thermal stratification (TS) of the charge develops naturally due to heat transfer and convection. Even though the fuel/air mixtures are compositionally homogeneous, this TS will produce sequential autoignition which reduces the HRR, and thus, helps to control the pressure rise rates (PRR). However, the effectiveness of thermal stratification for HRR control depends on the temperature sensitivity of the fuel, i.e. it should be more effective for fuels with higher temperature sensitivity. In FIG. 3(*a*) DMPN showed considerably higher temperature sensitivity than gasoline at $P_{in}$=1.0 bar. Although similar $T_{in}$ sweeps were not conducted at $P_{in}$=2.4 bar (because the $T_{in}$ is already low at 60° C.), the temperature sensitivity of DMPN also appears to be higher than gasoline at this boost pressure.

Example 10

Figure 11:
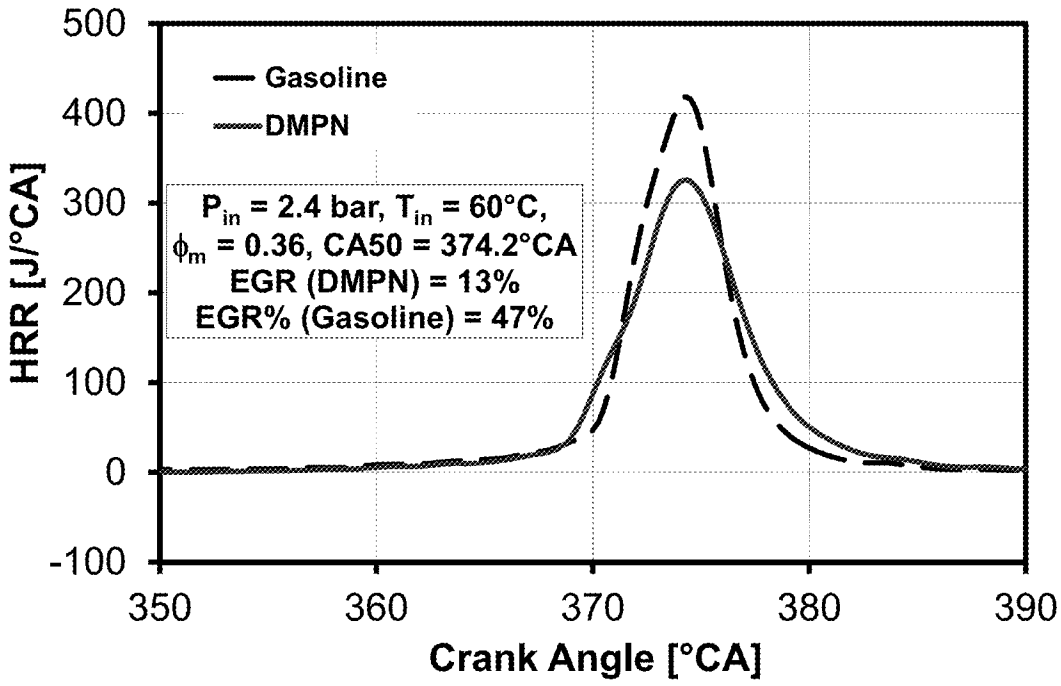
FIG. 11 is a graph showing HRR versus crank angle of gasoline and DMPN at similar HCCI operating conditions.

In Example 10 a comparison of HRR of DMPN and gasoline at similar HCCI operating conditions. As indicated, $P_{in}$, $T_{in}$, ϕm, and CA50 are the same for both fuels. DMPN used less EGR due to lower autoignition reactivity. FIG. 11 shows that for the same CA50, combustion starts earlier and ends later with DMPN compared to gasoline for an otherwise nearly identical operating condition. Considering that the amount of TS should be almost the same for DMPN and gasoline since the $T_{in}$ and wall temperatures are nearly the same, differences in the HRR curves in FIG. 11 indicate DMPN's higher temperature-sensitivity at this elevated intake pressure compared to gasoline. The resulting longer burn duration of DMPN reduces its HRR and ringing intensity relative to gasoline at the same CA50. Alternatively, for a given ringing intensity, the CA50 of DMPN can be more advanced, resulting in a higher thermal efficiency, as seen in FIG. 10(*a*). As a result, even though the fueling rate ($\phi_m$) of DMPN is lower than for gasoline at the high-load limit, $\phi_m$=0.440 vs. 0.465, the maximum $IMEP_g$ reached by DMPN is almost identical to that of gasoline due to its higher thermal efficiency. It should be mentioned that the higher thermal efficiency of DMPN is also supplemented by the lower EGR requirement compared to gasoline at similar loads, as shown by the intake-$O_2$ plots in FIG. 10(*b*). Due to the lower autoignition reactivity of DMPN, significantly less EGR was required to control CA50, resulting in a higher γ for the expansion stroke, so more work is extracted and the thermal efficiency is higher.

In addition to the high temperature sensitivity, another factor enabling DMPN to reach about 14 bar $IMEP_g$ is that $T_{in}$=60° C., which is the same as gasoline. Having the same intake temperature results in similar charge densities, so that similar fueling rates can be used. In contrast, ethanol requires higher intake temperatures (>85° C.) due to its much lower autoignition reactivity at this boost pressure, which reduces the charge density and limits the fueling rate. As a result, the maximum $IMEP_g$ of ethanol is considerably lower, even though it may have a stronger temperature-sensitivity than DMPN at this $P_{in}$, and it does not use any EGR.

Example 11

Other performance data based on the experiments done at boosted pressure in Examples 9 and 10 show that $NO_x$ emissions are more than an order of magnitude lower than those at naturally aspirated conditions or the US2010 $NO_x$ limit (FIG. 10(*c*). This is primarily because of the lower intake temperatures used by all the three fuels. Combustion efficiency remains above 97% over the load sweep for all three fuels. The higher combustion efficiency of gasoline is probably due to its high EGR % which allowed a significant portion of the exhaust gases to be burned a second time. Comparing the cycle-to-cycle variations of $IMEP_g$ and CA10 in FIG. 10(*d*) with those in FIG. 4 indicates that overall, the combustion is more stable at $P_{in}$=2.4 bar than at $P_{in}$=1.0 bar. FIG. 10(*d*) also shows that the COV of CA10 for DMPN is consistently a little higher than that of gasoline, despite the more advanced CA50 of DMPN (FIG. 10(*a*)). This suggests a higher temperature sensitivity for DMPN, and it is consistent with the observations in FIG. 11. Also, the even larger CA10 variations of ethanol suggest its temperature sensitivity is the highest among the three fuels at this boost pressure.

In summary of Examples 8-11, the results show that for $P_{in}$=2.4 bar, DMPN has autoignition behavior between that of gasoline and ethanol. Ethanol represents fuels with very low autoignition reactivity, showing low reactivity at $P_{in}$=1 bar, and increased pressure causes only a modest enhancement in its reactivity. Gasoline represents a different type of fuel; its reactivity is low at $P_{in}$=1 bar, but it is enhanced significantly by increased pressure. At $P_{in}$ about 1.8 bar, the required $T_{in}$ for gasoline drops to 60° C., and EGR is required at higher pressures for combustion phasing/knock control. In contrast, DMPN shows a lower reactivity at $P_{in}$=1.0 bar than either gasoline or ethanol, but its reactivity—in terms of $T_{BDC}$ reduction with $P_{in}$—is enhanced by pressure in a similar manner to gasoline. However, because DMPN requires a much higher $T_{in}$ than gasoline at $P_{in}$=1.0 bar, its required $T_{in}$ does not reach 60° C. until $P_{in}$ is about 2.4 bar. At this pressure, DMPN still preserves some of the characteristics of low-reactivity fuels. For example, compared to gasoline, its autoignition is still quite temperature sensitive, which allows the naturally occurring thermal stratification to be more effective for reducing the HRR, so less CA50 retard is required to control knock. Also, since $T_{in}$=60° C. has just been reached at $P_{in}$=2.4 bar, and combustion is less retarded, DMPN requires much less EGR than gasoline. Both the more advanced CA50 and less EGR act to increase its thermal efficiency over that of gasoline. Therefore, although the CA50 of DMPN cannot be retarded as much as gasoline to allow a similar fueling rate, it reaches a similar high-load limit due to its higher thermal efficiency. For other boost pressures, which were not tested, it is anticipated that the maximum loads of DMPN and gasoline will be similar at $P_{in}$>2.4 bar. This should continue until the maximum load of gasoline becomes oxygen limited at $P_{in}$ about 2.6 bar, beyond which DMPN could produce higher maximum loads with more oxygen available to support higher fueling rates. At $P_{in}$<2.4 bar, DMPN would likely produce lower maximum IMEPs than gasoline since the $T_{in}$ would be higher than 60° C., which limits the charge density and therefore, the charge mass, similar to ethanol at $P_{in}$=2.4 bar in FIG. 10.

For the open-chain ketone, DMPN, the autoignition shows strong temperature sensitivity (but less than CPN), and also fairly strong pressure sensitivity, much stronger than ethanol but somewhat weaker than gasoline. The autoignition being sensitive to both temperature and pressure is unique to DMPN, and this provides some unusual properties for its performance at high-load boosted conditions, as shown in Examples 8-11.

In summary, it was found that CPN had the lowest autoignition reactivity of all the biofuels and gasoline blends tested in this HCCI engine. The combustion timing of CPN is also the most sensitive to intake-temperature ($T_{in}$) variations, and it is almost insensitive to intake-pressure ($P_{in}$) variations. These characteristics and the overall HCCI performance of CPN are similar to those of ethanol.

DMPN shows multi-faceted autoignition characteristics. DMPN has strong temperature-sensitivity, even at boosted $P_{in}$, which is similar to the low-reactivity ethanol and CPN. On the other hand, DMPN shows much stronger pressure-sensitivity than ethanol and CPN. This pressure-sensitivity reduces the $T_{in}$ requirement for DMPN as $P_{in}$ increases, in a manner similar to gasoline, and it allows the same $T_{in}$=60° C. for DMPN as for gasoline at $P_{in}$=2.4 bar. At this $P_{in}$, DMPN reaches a maximum HCCI load similar to gasoline, i.e., about 14 bar IMEP. Unlike gasoline, which requires significant combustion-timing retard to prevent knock at this maximum load, DMPN allows a more advanced combustion timing because its high temperature-sensitivity causes a lower heat release rate. As a result, DMPN yields a higher thermal efficiency than gasoline at comparable loads. Accordingly, less fuel is required to do the same work, which equates to better fuel economy. Thus, DMPN also produces lower greenhouse gas emissions from the engine operation, in addition to the reduction that results from it being produced from a renewable source.

All patents, patent applications, publications, technical and/or scholarly articles, and other references cited or referred to herein are in their entirety incorporated herein by reference to the extent allowed by law. The discussion of those references is intended merely to summarize the assertions made therein. No admission is made that any such patents, patent applications, publications or references, or any portion thereof, are relevant, material, or prior art. The right to challenge the accuracy and pertinence of any assertion of such patents, patent applications, publications, and other references as relevant, material, or prior art is specifically reserved.

In the description above, for the purposes of explanation, numerous specific details have been set forth in order to provide a thorough understanding of the embodiments. It will be apparent however, to one skilled in the art, that one or more other embodiments may be practiced without some of these specific details. The particular embodiments described are not provided to limit the invention but to illustrate it. The scope of the invention is not to be determined by the specific examples provided above but only by the claims below. In other instances, well-known structures, devices, and operations have been shown in block diagram form or without detail in order to avoid obscuring the understanding of the description. Where considered appropriate, reference numerals or terminal portions of reference numerals have been repeated among the figures to indicate corresponding or analogous elements, which may optionally have similar characteristics.

It should be appreciated that the terms "a," "an," and "the" should be interpreted to mean "one or more" unless context clearly indicates to the contrary. The term "or" is not meant to be an exclusive "or" unless context clearly indicates to the contrary. It should also be appreciated that reference throughout this specification to "one embodiment", "an embodiment", "one or more embodiments", or "different embodiments", for example, means that a particular feature may be included in the practice of the invention. Similarly, it should be appreciated that in the description various features are sometimes grouped together in a single embodiment, figure, or description thereof for the purpose of streamlining the disclosure and aiding in the understanding of various inventive aspects. This method of disclosure, however, is not to be interpreted as reflecting an intention that the invention requires more features than are expressly recited in each claim. Rather, as the following claims reflect, inventive aspects may lie in less than all features of a single disclosed embodiment. Thus, the claims following the Detailed Description are hereby expressly incorporated into this Detailed Description, with each claim standing on its own as a separate embodiment of the invention.

It is claimed:

1. An enhanced fuel for an internal combustion engine comprising:

a majority portion of a fuel selected from the group consisting of: gasoline, diesel, alcohol fuel, biofuel, renewable fuel, Fischer-Tropsch fuel, and combinations thereof; and a minority portion of a blending agent;

wherein the blending agent includes a ketone-based blending agent that is a derivative of cyclopentanone corresponding to formula I:

I

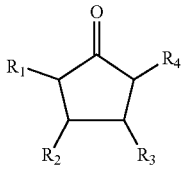

wherein each R group is independently selected from H, $CH_2CH_3$, or $CH_3$, and at least one R is $CH_2CH_3$ or $CH_3$;

wherein the blending agent is exclusive of an amide;

wherein the majority portion of the fuel is present in a ratio of 95:5 to 51:49 by volume of the ketone-based blending agent.

2. The enhanced fuel of claim 1, wherein the majority portion is gasoline or a blend of gasoline and ethanol.

3. The enhanced fuel of claim 1, wherein the majority portion of the fuel has a research octane number of 50 to 150.

4. The enhanced fuel of claim 3, wherein the enhanced fuel has a research octane number 5 to 100% higher than the research octane number of the majority portion of the fuel.

5. An enhanced fuel for an internal combustion engine comprising:

a majority portion of a gasoline or blend of gasoline and ethanol; and a minority portion of a blending agent;

wherein the blending agent includes a ketone-based blending agent that is cyclopentanone or a derivative of cyclopentanone;

wherein the majority portion of the fuel is present in a ratio of 95:5 to 51:49 by volume of the ketone-based blending agent.

6. The enhanced fuel of claim 5, wherein the derivative of cyclopentanone corresponds to formula I:

I

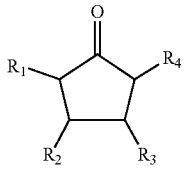

wherein each R group is independently selected from H, $CH_2CH_3$, or $CH_3$, and at least one R is $CH_2CH_3$ or $CH_3$.

7. The enhanced fuel of claim 1, wherein the majority portion of the fuel is diesel fuel.

8. The enhanced fuel of claim 1, wherein the fuel includes gasoline and the ketone-based blending agent is present in the enhanced fuel in an amount of 20 to 40% by volume.

9. The enhanced fuel of claim 5, wherein the blending agent is exclusive of an amide.

10. The enhanced fuel of claim 5, wherein the majority portion of the fuel has a research octane number of 50 to 150.

11. The enhanced fuel of claim 10, wherein the enhanced fuel has a research octane number 5 to 100% higher than the research octane number of the majority portion of the fuel.

* * * * *